US006009818A

United States Patent [19]

Card et al.

[11] Patent Number: 6,009,818

[45] Date of Patent: Jan. 4, 2000

[54] TUFTING MACHINE PATTERN YARN FEED DEVICE

[75] Inventors: Roy T. Card, Chattanooga, Tenn.; Wilton Hall, Ft. Oglethorpe, Ga.; Michael L. Kilgore, Whitwell, Tenn.

[73] Assignee: Card-Monroe Corp., Chattanooga, Tenn.

[21] Appl. No.: 09/067,466

[22] Filed: Apr. 28, 1998

Related U.S. Application Data

[63] Continuation-in-part of application No. 08/843,559, Apr. 18, 1997, Pat. No. 5,743,201, which is a continuation-in-part of application No. 08/376,345, Jan. 23, 1995, Pat. No. 5,622, 126.

[51] Int. Cl.[7] ..... D05C 15/18

[52] U.S. Cl. ..... 112/80.73

[58] Field of Search ..... 112/80.73, 80.7, 112/80.01, 302

[56] References Cited

U.S. PATENT DOCUMENTS

| | | | |
|---|---|---|---|
| 2,880,684 | 4/1959 | Masland, II | 112/79 |
| 3,134,529 | 5/1964 | Beasley | 226/110 |
| 4,411,207 | 10/1983 | Brock et al. | 112/79 |
| 4,856,441 | 8/1989 | Kurata | 112/80.73 |
| 4,864,946 | 9/1989 | Watkins | 112/80.73 |
| 5,182,997 | 2/1993 | Bardsley | 112/80.73 |
| 5,544,605 | 8/1996 | Frost | 112/80.73 X |
| 5,622,126 | 4/1997 | Card et al. | 112/80.73 |
| 5,743,201 | 4/1998 | Card et al. | 112/80.73 |
| 5,806,446 | 9/1998 | Morrison et al. | 112/80.73 |

*Primary Examiner*—Ismael Izaguirre
*Attorney, Agent, or Firm*—Womble Carlyle Sandridge & Rice, PLLC

[57] ABSTRACT

A pattern yarn feed device for use with a tufting machine in the manufacture of tufted articles includes at least one yarn feed roll assembly positioned on a frame of a tufting machine adjacent a yarn feed path. The yarn feed roll assembly has an elongate rotatable yarn feed roll having an exterior yarn driving periphery for engaging yarns thereon. A drive motor is provided for rotating the yarn feed roll. At least one yarn applying member, preferably a rotatable pinch roller, is provided as a part of the yarn feed roll assembly, and extends parallel to the yarn feed roll, and is orbitally moveable about the yarn feed roll. The at least one yarn applying member is selectively moveable from a first yarn receiving position spaced from the periphery of the yarn feed roll for receiving an intermediate portion of selected ones of the tufting yarns thereon, into a yarn applying position engaged with at least a portion of the yarn driving periphery of the yarn feed roll for applying the selected ones of the yarns thereto. In separate constructions, the pinch roller may be eccentrically orbited about the yarn feed roll from the yarn applying position into the yarn receiving position, or may be concentrically orbited about the yarn feed roll and then selectively moved into the yarn applying position at the completion of its orbital rotation about the yarn feed roll. In its yarn applying position, the pinch roller is normally resiliently urged into engagement with the periphery of the yarn feed roll.

26 Claims, 15 Drawing Sheets

TUFTING MACHINE PATTERN YARN FEED DEVICE

CROSS REFERENCE TO RELATED APPLICATION

This application is a continuation-in-part of U.S. patent application Ser. No. 08/843,559 entitled Tufting Machine Pattern Yarn Feed Mechanism filed Apr. 18, 1997, now U.S. Pat. No. 5,743,201, which application is a continuation-in-part of Ser. No. 08/376,345, and U.S. Pat. No. 5,622,126 issued Apr. 22, 1997 and entitled Tufting Machine Yarn Feed Mechanism, filed in the United States Patent and Trademark Office on Jan. 23, 1995.

FIELD OF INVENTION

This invention relates in general to tufting machines. More particularly, the invention relates to an improved tufting machine pattern yarn feed device used to selectively feed selected ones of the tufting yarns to the tufting needles of a tufting machine for manufacturing a patterned tufted article.

BACKGROUND OF THE INVENTION

The use of a pattern yarn feed attachment such as a scroll attachment, for use in selectively feeding selected ones of a plurality of yarns to the needles of a tufting machine for tufting a pattern in the face of an article in accordance with a predetermined pattern is known. Such pattern yarn feed devices control the rate at which selected ones of the tufting yarns are fed to selected ones of the tufting needles as the needles are reciprocably passed through a backing material advanced laterally underneath the needles of the tufting machine, through a tufting zone, while tufting the patterned article. The yarn feed rate will in turn control the pile height of the yarns, or tufts, sewn into the backing material, usually by causing certain ones of the tufting yarns to be "back robbed" from the previously sewn tufts in the backing material so that a "full" height tufted pile is not sewn relative to the pile height of the surrounding tufts of yarn. The degree to which the yarn is back robbed will determine how much of that yarn is visible in the face of the finished article.

With the known pattern yarn feed devices, it has usually been necessary, when a yarn breaks or when different yarns are selected to be fed to different selected ones of the needles of the tufting machine during a pattern changeover, i.e., when the pattern to be tufted in the face of the article is changed from a first pattern to a second differing pattern, to re-wrap such yarns about the appropriate yarn drive or feed roll, or rolls, and then re-thread each of the tufting needles. This threading and/or re-threading of the needles is generally a laborious and time intensive process as each yarn must be separately wrapped about the appropriate yarn drive roll and then threaded or re-threaded through a respective one of what may be several hundred tufting needles thereafter. This typically is required each time there has been a change in the yarn feed sequence, i.e. the pattern, of the tufting yarns used to produce the article on the tufting machine.

As the operating speeds of tufting machines have increased due to improvements in the design, construction, and control of tufting machines and their related drives, more precise control over the feed rates of the yarns as they are being fed to the needles of these tufting machines is necessary in order to ensure that an acceptable pattern definition is tufted into the articles being produced. This in turn has required that improved yarn feed devices be developed which can feed the selected tufting yarns to the desired needles of the tufting machine at the increased rates of speed necessary in order to permit these increased production rates to be realized. Such improved yarn feed devices, however also must maintain precise control over the individual yarns so that an acceptably defined pattern is tufted in the face of the articles so produced in order to allow tufted article manufacturers to fully realize, and thus obtain the benefit of, the increased operating efficiencies permitted by these tufting machines to produce high quality tufted articles.

What is needed, therefore, but seemingly unavailable in the art, is an improved tufting machine pattern yarn feed device that allows for a high degree of precision in the control of the yarn feed rates to control of the quality of the patterns being tufted in the articles being so produced. Moreover, there is a need for such an improved pattern yarn feed device which will permit a tufting machine operator to quickly and easily change the sequence of yarns fed to the needles across the width of the tufting machine, and to be able to do so within easy reach while standing on the floor of the manufacturing facility within which the tufting machine is situated, or while standing on a work platform positioned with respect to the tufting machine without otherwise requiring the use of additional staging, platforms, and/or ladders to reach the pattern yarn feed device.

What is also needed is an improved tufting machine pattern yarn feed device which dispenses with the necessity of cutting the yarns during pattern changeover in order to quickly pass the yarns about different yarn feed rolls, and which will not otherwise require that the yarns be re-threaded through the needles during such a pattern changeover. Such a construction should preferably eliminate the necessity of manually wrapping individual ones of a yarns separately about the selected yarn feed roll, or rolls, in order to adjust the feed rate of the respective yarns. Additionally, what is needed is such an improved tufting machine pattern yarn feed device that allows for the amount of yarn wrap about selected ones of the yarn feed rolls to be quickly and easily adjusted as desired, or as required, for control of the yarns being used to tuft the pattern in the face of the article, and which allows a machine operator to selectively pinch selected ones of the yarns against the yarn feed roll with a pinch roller for still greater control over the feeding of the yarns.

SUMMARY OF THE INVENTION

The present invention provides an improved tufting machine yarn feed device which overcomes some of the design deficiencies of other yarn feed devices known in the art, and which represents a significant advance in the art. The improved tufting machine yarn feed device of this invention enables intermediate portions of desired yarns to be selected, after having been first threaded through the needles of the tufting machine, and moved against and selectively wrapped about any selected yarn feed roll, thereby eliminating the necessity of first wrapping the yarns around the yarn feed roll, and then threading, or re-threading the needles when pattern changes in the tufted article are made. This reduces the time required to make a change in yarn sequence across the width of the tufting machine significantly, and also eliminates the need for cutting each end of the yarns when changing the yarn drive or feed from one yarn feed roll to another.

The present invention includes a conventional tufting machine with a spaced series of tufting needles carried by one or more needle bars being reciprocated toward and away from a backing material passing under the needle bar and through a tufting zone defined with respect to the tufting needles, the tufting machine having a plurality of parallel yarn feed rolls disposed adjacent the path of travel of the yarns from a yarn supply, for example a creel, to the respective needles of the machine.

In a preferred embodiment of the invention, at least one yarn applying member, for example a pinch roller, is provided which extends parallel to the yarn feed roll and is moveable about the yarn feed roll in an orbital path. The pinch roller is selectively moveable from a yarn receiving position spaced from the yarn feed roll for receiving an intermediate portion of selected ones of the tufting yarns thereon, into a yarn applying position engaged with at least a portion of the yarn driving periphery of the yarn feed roll for applying the selected ones of the yarns thereto. As the orbital path of the pinch roller about the yarn feed roll is adjustable, the amount of yarn "wrap" about at least a portion of the yarn driving periphery of the yarn feed roll is adjustable, for providing the desired degree of control over the yarn feed rate.

The pinch roller extends between a pair of opposed and radially extending indexing plates or discs, which are journaled for rotation concentrically about the axis of the feed roll. A pair of carrier arms are privotally fastened to the opposed pair of indexing discs, and the ends of the at least one yarn applying member are journaled therein for rotation. The carrier arms are spring-loaded and thus yieldably urge the pinch roller into compressive engagement with at least a portion of the yarn driving periphery of the yarn feed roll. A cam lever, generally comprising an elongate lever having a cam formed at one end thereof, is operably engaged on an end of each carrier arm opposite the end on which the pinch roller is journaled, and is sized and shaped to selectively move the pinch roller against the springs of the carrier arms, to selectively move the pinch roller from the yarn applying position to the yarn receiving position.

Additionally, each yarn feed roll has at least one elongate yarn control rod which is circumferentially spaced, and extends parallel to the yarn feed roll. The yarn control rod is received at its respective ends by a pair of opposed sockets formed or mounted on the opposed pair of indexing discs, and is releasably held therein so that the yarn control rod also orbits the yarn feed roll. So constructed, when the radially extending indexing plates or discs are rotated about the axis of the yarn feed roll, both the pinch roller and the yarn control rod are rotated together about the yarn feed roll. The indexing plates are concentrically mounted about the longitudinal axis of their associated yarn feed roll, and are constructed and arranged to permit the pinch roller and the yarn control rod to be selectively and incrementally indexed about the yarn feed roll to selected positions for applying the yarns to a portion of the yarn periphery of their associated yarn feed roll.

The pinch roller is preferably journaled on the carrier arms of the respective yarn feed roll assemblies, and the yarn control rods provided as a part of each such assembly are arranged in a circumferentially spaced parallel relationship with respect to the yarn feed roll with which each pinch roller and the control rods are associated. The pinch roller and the control rods are spaced from the periphery of their associated yarn feed roll. The pinch roller is constructed and arranged to selectively wrap selected ones of the yarns at least partially about the yarn driving periphery of the yarn feed roll, whereas the control rods are constructed and arranged to hold intermediate portions of the selected ones of the yarns out of engagement with the yarn driving periphery of the yarn feed roll.

The improved yarn feed device of the present invention thus includes a plurality of yarn feed roll assemblies arrayed in a spaced series extending away from the frame of the tufting machine. Each of the yarn feed roll assemblies is along either an arcuate or straight line, as desired, and supported on the tufting machine at a position at which machine operators can conveniently gain access to the yarn feed rolls, the control rods, the pinch rollers, and the yarns being fed by the yarn feed device for greatly decreasing the amount of time needed for yarn handling during pattern changeover, as well as for improved machine serviceability.

Each yarn feed roll is individually driven by a separate servomotor, although other suitable drive mechanisms may be used in lieu of servomotors to include conventional AC and/or DC electric motors used with gear reducers, for example. Each servomotor may be provided with a suitable position feedback device, for example a transducer or a resolver, and will be controlled either by separate control processor, or by a common control processor, typically a computer, as desired, and in which the common control processor may also be adapted to control some or all of the other operations performed by the tufting machine so as to synchronize the yarn feed with the reciprocation of the needles, as well as the feed of the backing material, through the tufting zone.

The pinch roller is used in lieu of at least one control rod, and more preferably in place of all but one additional control rod, to not only wrap the yarn about at least a portion of the periphery of the appropriate yarn feed roll, but also to more positively control the rate of yarn feed during the tufting of the desired pattern in the article by pinching the yarn therewith against at least a portion of the periphery of the yarn feed roll. The pinch roller is constructed to be quickly and easily removed from the pair of spaced, radially extending, opposed indexing plates positioned at the opposite ends of the yarn feed roll and on which the pinch roller is supported for allowing a machine operator to quickly pass the pinch roller underneath selected ones of the yarns during pattern changeover, and to then replace the pinch roller on its indexing plates with the selected ones of the yarns passing between the pinch roller and its associated yarn feed roll.

The pinch roller at first does not wrap the selected yarns about the periphery of the yarn feed roll until such time as the pinch roller is orbitally rotated about the yarn feed roll on its indexing plates to move the selected yarns into engagement with at least a portion of the periphery of the yarn drive roll. The pinch roller is constructed to be selectively moved into engagement with a portion of the periphery of the yarn feed roll whereupon the pinch roller not only wraps the yarn, or yarns, at least partially about the periphery of the yarn feed roll in the same fashion as a control rod, but also pinches these yarns against the yarn feed roll to more positively control the feed rate of the yarns to the appropriate tufting needles.

Accordingly, it is an object of the present invention to provide a pattern yarn feed device for a tufting machine which will permit intermediate portions of selected yarns to be at least partially wrapped about selected yarn feed rolls without the necessity of re-threading or manually wrapping the yarns around the yarn feed rolls, or re-threading the needles of the tufting machine.

Another object of the present invention is to provide an improved yarn feed device which enables selected yarns to be easily placed in contact with a prescribed yarn feed roll for being fed at a prescribed rate thereby, and which can be readily and easily changed to contacting another feed roll capable of feeding the yarn at a different feed rate.

Other objects, features and advantages of the present invention will become apparent from the following description, considered in conjunction with the accompanying drawings.

DETAILED DESCRIPTION OF THE PREFERRED EMBODIMENTS

Figure 1:
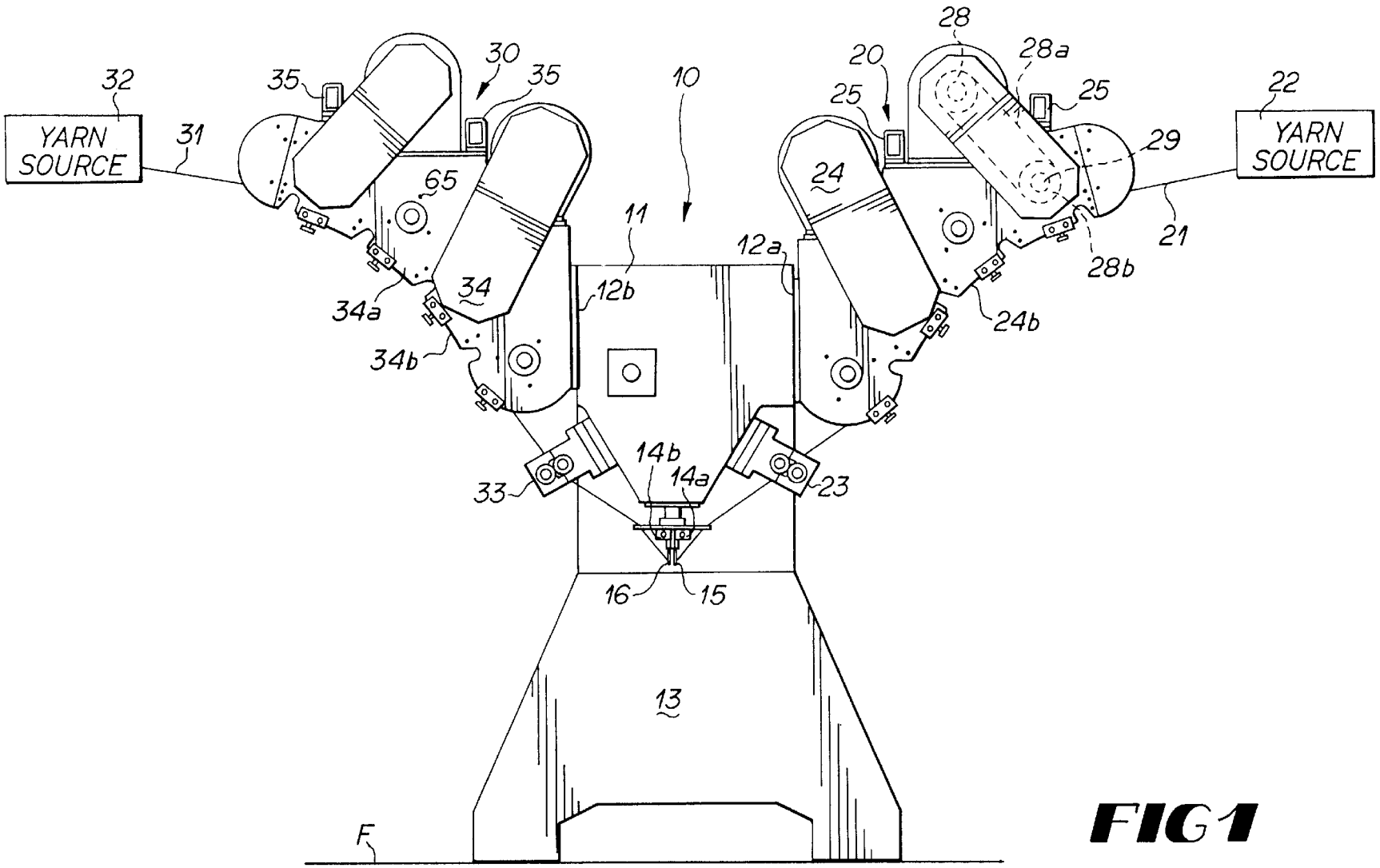
FIG. 1 is a schematic side elevational view of a conventional tufting machine having separate front and rear pattern yarn feed devices of a first embodiment constructed in accordance with the present invention.

Referring now in detail to the drawings, in which like reference characters and numerals indicate like parts throughout the several views, numeral 10 of FIG. 1 denotes generally a known type of tufting machine having a head 11 supported on a pair of front and rear opposed, vertically disposed, side plates 12*a* and 12*b* forming a framework so that head 11 is supported on a base 13. Tufting machine 10 is shown as having two reciprocable needle bars 14*a* and 14*b*, each of which carries a spaced series of tufting needles 15 and 16, respectively, along the length of the respective needle bars, although only a single needle bar may be provided, as desired. In known fashion, the needle bars may be laterally shiftable with respect to one another, and are constructed and arranged to be reciprocably moved toward and away from a tufting zone (not illustrated) extending in a plane defined perpendicularly with respect to and beneath the two rows of needles 15,16. A backing material (not illustrated) is transversely passed through the tufting zone in known fashion so that needles 15,16 reciprocably pass through the backing material and sew tufts of yarn therein.

Figure 2:
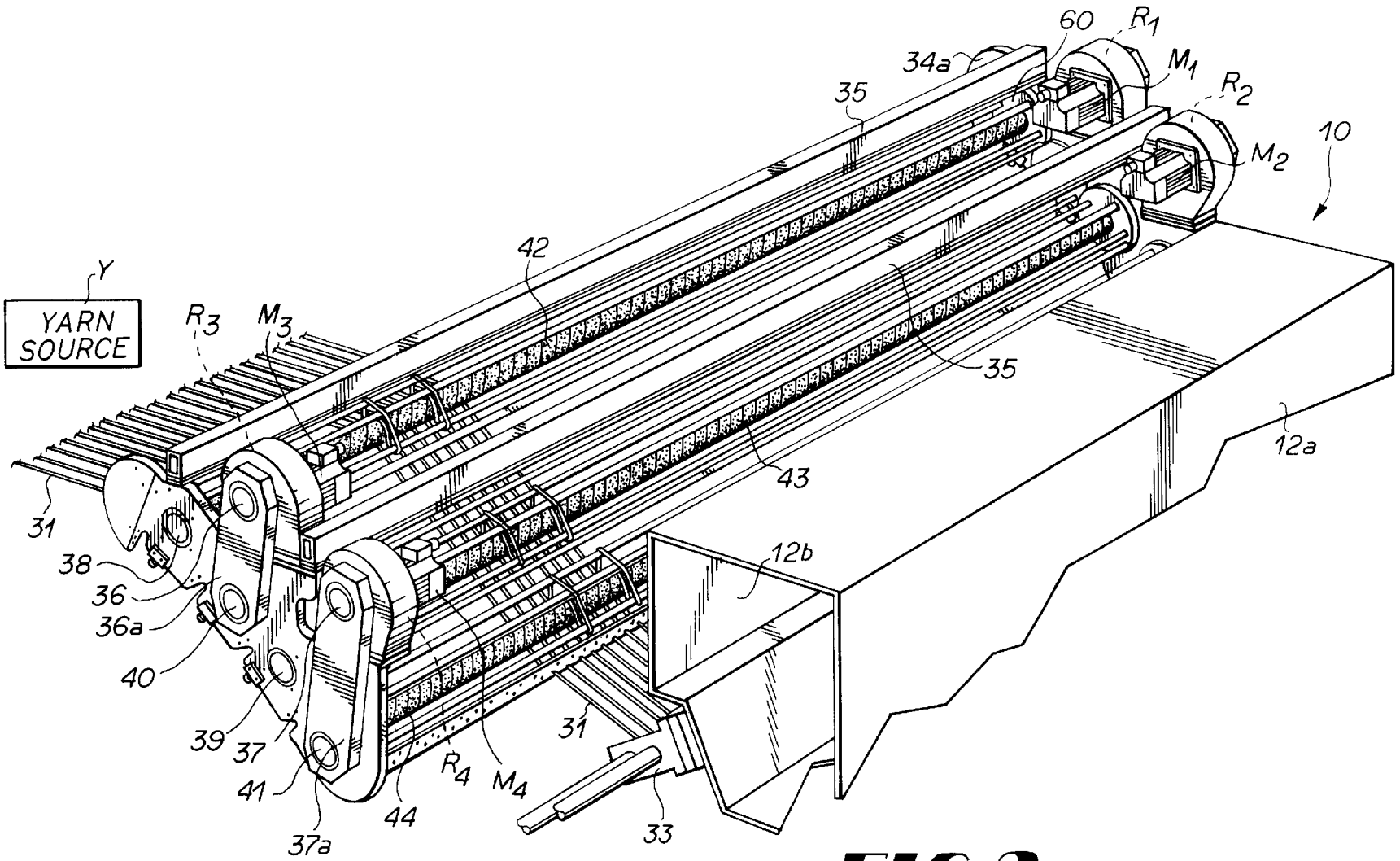
FIG. 2 is a fragmentary perspective view of a portion of the front yarn feed device of FIG. 1.

A rear yarn feed device 20, also referred to as a pattern yarn feed attachment (not illustrated), is illustrated in FIG. 1 having two or more transversely spaced, vertically disposed, and opposed end support brackets 24 which extend upwardly and rearwardly away from a plate 12*a* of head 11. Spaced parallel, transverse beams or cross bars 25 extend between brackets 24 and join the upper portions of the brackets to one another to create a structurally rigid load carrying framework for the yarn feed device, as shown in FIG. 2.

Rear yarn feed device 20 of FIG. 1 feeds a plurality of rear yarns 21 in an inwardly and downwardly direction from a rear yarn source 22, for example a creel, schematically illustrated in FIG. 1, via the yarn feed device 20, in conjunction with a yarn puller 23, the yarn puller having a pair of spaced and counter-rotating yarn puller rollers which together pull the yarns toward the needles 15 of needle bar 14*a*.

In like fashion, a front plate 12*b* supports a front yarn feed device 30, or pattern yarn feed attachment, which is complimentary to rear yarn feed device 20, except that it is mounted on front plate 12*b* in opposite hand of yarn feed device 20, as best shown in FIG. 1. Front yarn feed device 30 also includes two or more transversely spaced, vertically disposed, and opposed end support brackets or plates 34 which extend upwardly and forwardly away from plate 12*b* of head 11, with a plurality of transverse beams or cross bars 35 extending therebetween and joining the upper edges of brackets 34 together to form a rigid frame assembly for supporting the front yarn feed device. These two frame assemblies, respectively, support the rear and front yarn feed devices on the tufting machine with respect to needle bars 14*a*, 14*b*, and are constructed so as to position the yarn feed device at a convenient working height for machine operators, so that they may easily change the yarn feed sequence (pattern) as described in greater detail, below, and so that machine service technicians can gain ready access to the components of the yarn feed devices for service and repair thereof.

As it is understood by those skilled in the art that only one of needle bars 14*a* and 14*b* illustrated in FIG. 1 need be present, it follows that only one of yarn feed devices 20, 30 need be provided therefor. As rear yarn feed device 20 is identical to front yarn feed device 30, with the noted exception of being in opposite hand, the remainder of the description of this construction of the two pattern yarn feed devices is devoted primarily to front yarn feed device 30, it being understood that similar components are contained in rear yarn feed device 20.

Figure 9:
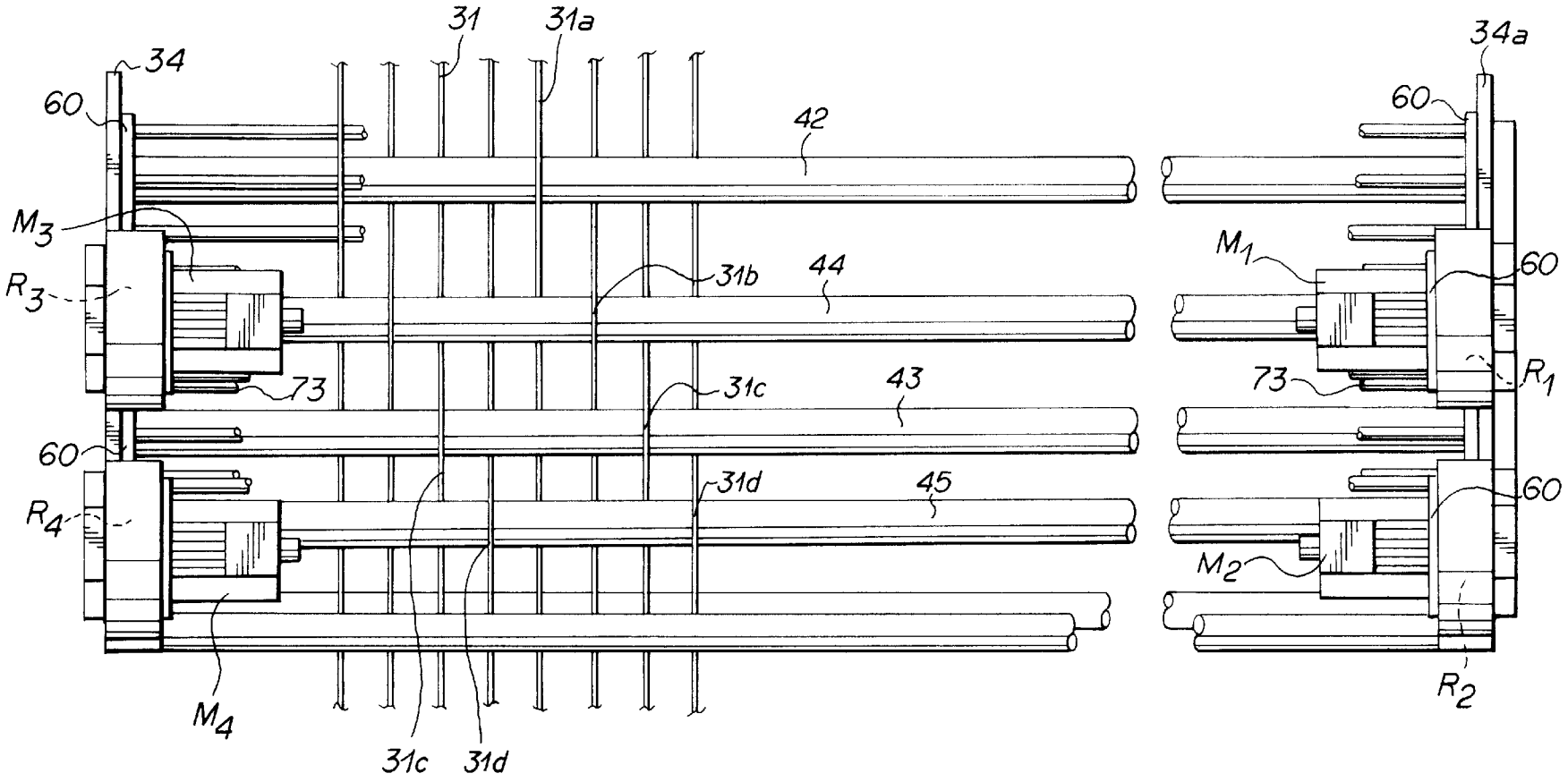
FIG. 9 is a fragmentary plan view of a portion of the yarn feed assembly shown in FIG. 2 illustrating selected ones of the yarns passed over selected ones of the control rods.

Front yarn feed device 30 has four servomotors M1, M2, M3 and M4, as shown in FIGS. 2, and 9, that drive shafts, such as drive shafts 36 and 37 illustrated in FIG. 2, through reducers R1, R2, R3 and R4, respectively. Drive shafts 36 and 37 in turn drive roll shafts 38, 39, 40 and 41, through conventional drive trains, the drive trains being housed within suitable covers, such as covers 36*a* and 37*a*. Each drive train includes a sheave, such as sheave 28 shown in broken lines in FIG. 1, driving an endless timing belt, such as belt 28*a*, which in turn drives a wheel or sheave, such as sheave 28*b*, on a roll shaft, such as roll shaft 29 in FIG. 1. Hence, the four servomotors M1, M2, M3, and M4, respectively, control and drive the four yarn feed rolls 42, 43, 44, and 45, respectively, as best shown in FIG. 9. Each of the four yarn feed rolls 42, 43, 44, 45 is provided with a roughened periphery, such as periphery 42*a* seen in FIG. 3. Below and on opposite sides of each yarn feed roll, for example roll 42, are a pair of angle iron yarn guides 55 and 56 which run parallel to the axes of the yarn feed rolls. The yarn guides 55 and 56 are each provided with a spaced series of transversely aligned staggered holes 55*a* and 56*a*, respectively, defined therein and through which respective ones of the yarns 31 pass. The ends of the yarn guides 55 and 56 are secured to and supported by the inner surfaces of the brackets 34 and 34*a*. Adjacent the apexes of yarn guides 55, 56 are yarn slide bars 57 and 58, as seen in FIG. 3, and over which the yarns are passed for carrying the yarns thereon with respect to the respective yarn feed roll assemblies supported on brackets 34, 34*a*.

Each yarn feed roll, for example roll 42, terminates inwardly of the inner surfaces of the brackets 34, 34*a*, so as to provide sufficient space to respectively receive an opposed pair of annular, radially extending, concentrically disposed control rod indexing plates 60 and 61. Each of indexing plates 60, 61 is rotatably journaled on brackets 34, 34*a*, respectively, by a flanged cylindrical sleeve 62 mounted by a flange (not illustrated) flat against the inner surface of bracket 34 or 34*a*, this flange being held in place by bolts 65, shown in FIG. 1. Each sleeve 62 also receives a bearing, such as bearing 64 (FIG. 3) for journaling the ends of the respective yarn feed roll shafts, such as shaft 38.

Figures 3, 4:
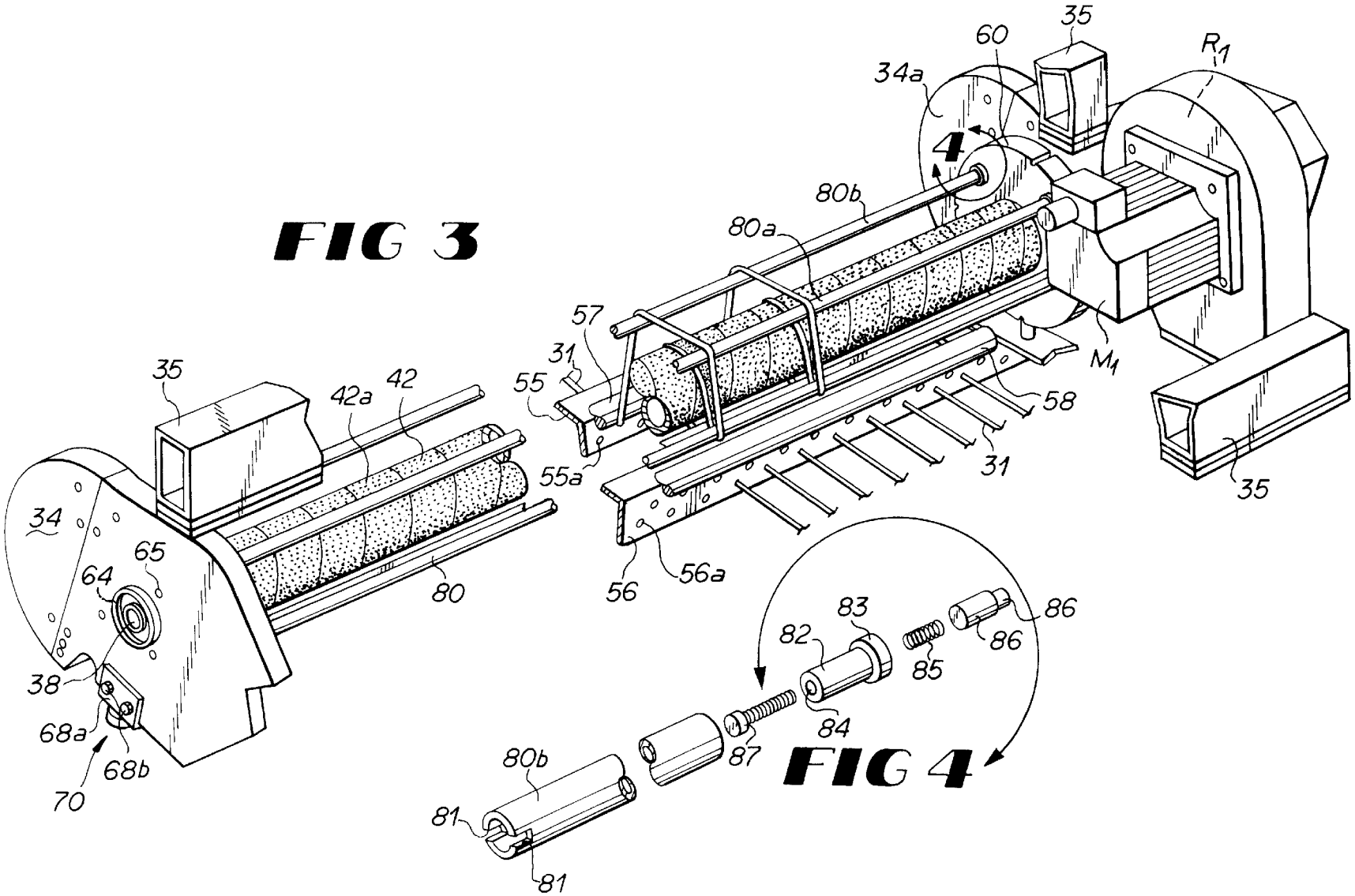
FIG. 3 is a fragmentary perspective view of one of the yarn feed roll assemblies, and its associated control rods, of the yarn feed device of FIG. 2.
FIG. 4 is an enlarged exploded perspective view taken in the region of numeral 4 in FIG. 3 illustrating an end portion of one of the control rods of the yarn feed roll assembly.

Referring now to FIG. 3, each of brackets 34, 34*a* is provided with a plurality of spaced detent members 68 (FIGS. 5–8), respectively, below the indexing plates 60, 61, each detent member including a channel shaped base 68*a* bolted, by bolts 68*b*, in place along the lower edge of the bracket 34 or 34*a*. A locking mechanism 70, i.e. a locking bolt or stop, is threadedly received in base 68*a* so that its distal end portion is adapted to be aligned selectively with any one of a plurality of spaced peripheral notches or recesses 72 (FIGS. 5 to 8) defined in the periphery of indexing plates 60, 61. These notches or recesses 72 are circumferentially spaced in the embodiment of the pattern yarn feed device of FIGS. 1–9 at approximate 90° intervals along the periphery of each indexing plate 60 or 61 so that a yieldable plunger 70*b* (FIG. 5) of the cooperating locking mechanism 70 can protrude into a selected notch 72 when that notch is aligned with the locking mechanism, as shown in FIGS. 5 to 8.

Referring now to FIGS. 5 to 8, locking mechanism 70 has an external knurled head 70*a* at its proximal end and carries a spring loaded plunger 70*b* at its distal end. Plunger 70*b* has a rounded tip suitable for being received in one of the recess 72. When the locking mechanism is released by retracting the head 70*a*, for example, plunger 70*b* is allowed to be yieldably moved toward base 68*a* for readily permitting the manual rotation of indexing plate 60 about its respective yarn feed roll. The plunger 70*b*, however, is normally resiliently urged into one of recess 72 when the indexing plate 60 aligns with the recess by a spring (not illustrated). Plunger 70*b* will yield to manual rotational force applied to the indexing plates 60, 61, but only when the locking mechanism is in its released position, i.e. head 70*a* has been released. Once the locking mechanism is tightened, it will lock indexing plates 60, 61 in the selected angular position.

For maintaining the opposed pairs of indexing plates 60, 61 in axial alignment with each other so that they may be simultaneously rotated, each pair of opposed indexing plates is provided with an alignment bar 73, seen in FIGS. 5 to 8, the ends of which are respectively received in opposed supports 75. Each alignment bar 73 is preferably a length of angle iron which is secured at its ends to the supports, such as support 75, which, in turn are bolted to the associated indexing plate 60 or 61.

Extending between each opposed pair of indexing plates 60, 61, and spaced approximately 90° apart from each other, are a plurality, preferably three, elongate, straight, polished steel yarn control rods 80, 80*a* and 80*b*, as shown in FIGS. 3 and 5 to 8. The control rods function as yarn applying members. Control rods 80, 80*a* and 80*b* are identical to one another, each rod, such as rod 80*b* in FIG. 4, for example, being a hollow tubular cylindrical member, the proximal end of which is provided with a pair of transverse notches 81 and the distal end of which is provided with a yieldable plug assembly. This plug assembly includes a lug 82 having a cylindrical body received in the distal end of rod 80*b* and an enlarged collar 83 at one of its ends. Lug 82 has an internal axial bore 84, and is counter-bored so as to provide an internal arresting flange (not shown) at collar 83. The bore 84 receives an axially movable plunger 86 having a protruding tip 86*a*, the plunger 86 being urged into a seated position against the internal flange of collar 83 by a coiled compression spring 85, spring 85 being confined in a compressed position within bore 84 by the end of machine screw 87 threadedly received in the end of bore 84 opposite plunger 86. Lug 82 is press fit into the distal end of the control rod, in FIG. 4 this being control rod 80*b*, so that the tip 86*a* of plunger 86 protrudes outwardly from the collar 83 of lug 82. The tip 86*a* thus forms a yieldable spring loaded detent for removably retaining the control rod in place between the two indexing plates 60, 61.

For receiving the ends of the yarn control rods 80, 80*a*, 80*b*, the indexing plates 60, 61 are provided with opposed pairs of holes, recesses, or sockets (not illustrated) spaced approximately 90 degrees apart from one another about the yarn feed roll. Each of the sockets of plate 60 will have a transverse pin (not shown) fixed in and extending across the socket for being received in slots 81 formed at the proximal end of control rod 80*b* for preventing the rotation of the control rod in the socket. This holds true as well for control rods 80 and 80*a*. This prevents the control rods from rotating about their own respective axes as the yarns passed thereabout are fed to the needles by the yarn feed roll 42, for example.

The spring loaded plunger 86, when depressed into the distal end of control rods 80. 80*a* or 80*b*, respectively, fits into corresponding sockets defined in the indexing plate 61 so as to yieldably hold the distal ends of control rods 80, 80*a*, 80*b* in their prescribed sockets. When, for example, the control rod 80*b* is urged in a direction toward its plunger 86, to the right in FIG. 3, plunger 86 will be urged into the lug 82 sufficiently so that the proximal end of the control rod may be removed from its control rod socket. Thus, control rods 80, 80*a*, 80*b* are easily removable from between the two indexing plates 60, 61 when it is desired to select yarns to be wrapped around respective ones of the yarn feed rolls, but are normally retained in positions parallel to each other and parallel to the axis of yarn feed rolls 42, 43, 44 or 45, respectively, spaced from the periphery of such yarn feed rolls transversely with respect to yarns 31.

So constructed, each one of the respective yarn feed rolls 42–45, as well as its accompanying indexing plates 60, 61, and its control rods 80–80*b*, and alignment bar 73 for joining the two opposed indexing plates together, form an integral yarn feed roll assembly. As shown in FIG. 1, therefore, there are four such yarn feed roll assemblies formed as a part of each one of the two pattern yarn feed devices, rear yarn feed device 20, and front yarn feed device 30. As described hereinabove, each one of the yarn feed roll assemblies can be rotated about its respective axis independently of the other ones of the yarn feed roll assemblies, and may be locked into any one of a variety of angular positions about the axis of the appropriate yarn feed roll for varying the angular wrap of respective ones of yarns 21, 31 about the respective ones of the yarn feed rolls, as described in greater detail below.

As best seen in FIG. 3, the yarn guides 55 and 56 for each yarn feed roll, such as yarn feed roll 42, are positioned sufficiently below the feed roll so that when the tufting machine is threaded, the yarns 31 pass from the yarn source 32, schematically illustrated in FIG. 1, through successive opposed pairs of aligned holes, such as holes 55*a*, 56*a* (FIG. 2), and thence to the next adjacent pair of yarn guides for the next adjacent yarn feed roll, and so on. All of the yarns 31 are passed in parallel, downward, and inwardly extending paths toward tufting machine 10 so that the intermediate portions of the yarns which pass between the pairs of yarn guides for each yarn feed roll, such as guides 55 and 56 of FIG. 3, associated with the respective yarn feed rolls 42, 43, 44, 45, yarn feed roll 42 in FIG. 3, are spaced outwardly and downwardly from the respective yarn feed rolls so that yarn increments are accessible by the machine operator, as he or she stands on the floor on which the tufting machine is positioned, or on a platform positioned at the tufting machine adjacent the appropriate yarn feed device 20 or 30, as the case may be.

When the needles 16 of tufting machine 10 are threaded with yarns 31, for example, a "blanket" of staggered, parallel yarns 31 (FIGS. 2, 9) are therefore fed from the yarn source 31 through opposed holes 55*a*, 56*a* (FIG. 3) in the uppermost yarn guides 55, 56, and then passed through appropriate holes in the next successive pair of yarn guides for the next successive yarn feed roll, and so on so that the yarns pass successively beneath each of yarn feed rolls 42, 43, 44, and 45, and so that none of the yarns 31 normally engage any portion of the external periphery of the respective yarn feed rolls. Yarns 31 are then passed through yarn puller 33 (FIG. 1), and then threaded through conventional yarn jerkers (not shown) mounted on the needle bar 14*b* with respect to the needles. Yarns 21 are threaded in the same manner through the rear yarn feed device 20 to needle bar 14*a* as are yarns 31 described above.

At this stage, none of the yarn feed rolls 42, 43, 44, 45 engage any of the yarns 31 however, yarns 31 are guided so that they pass outwardly of and adjacent the bottom peripheral portion of yarn feed rolls 42, 43, 44, 45 Yarn feed rolls 42, 43, 44 and 45 are positioned adjacent the bottom edges 34*b* of brackets 34 and 34*a* in spaced series, here an arcuate array (FIG. 1) facing upwardly and away from the tufting machine 10 so that their peripheries are spaced from and adjacent yarns 31, and are thus readily accessible to a machine operator standing at or near the tufting machine. Also, if so desired, it is anticipated that rear yarn feed device 20 and front yarn feed device 30 may each extend vertically upward and away from the tufting machine, extend upwardly and outwardly and horizontally away from the tufting machine, or may extend outwardly along a straight line angled away from the frame of the tufting machine as illustrated generally in FIG. 10. Yarn feed rolls 42, 43, 44 and 45, are, of course, parallel to one another and extend transversely across all of yarns 31 extending transversely across the width of the tufting machine, as illustrated in FIG. 1.

Figure 10:
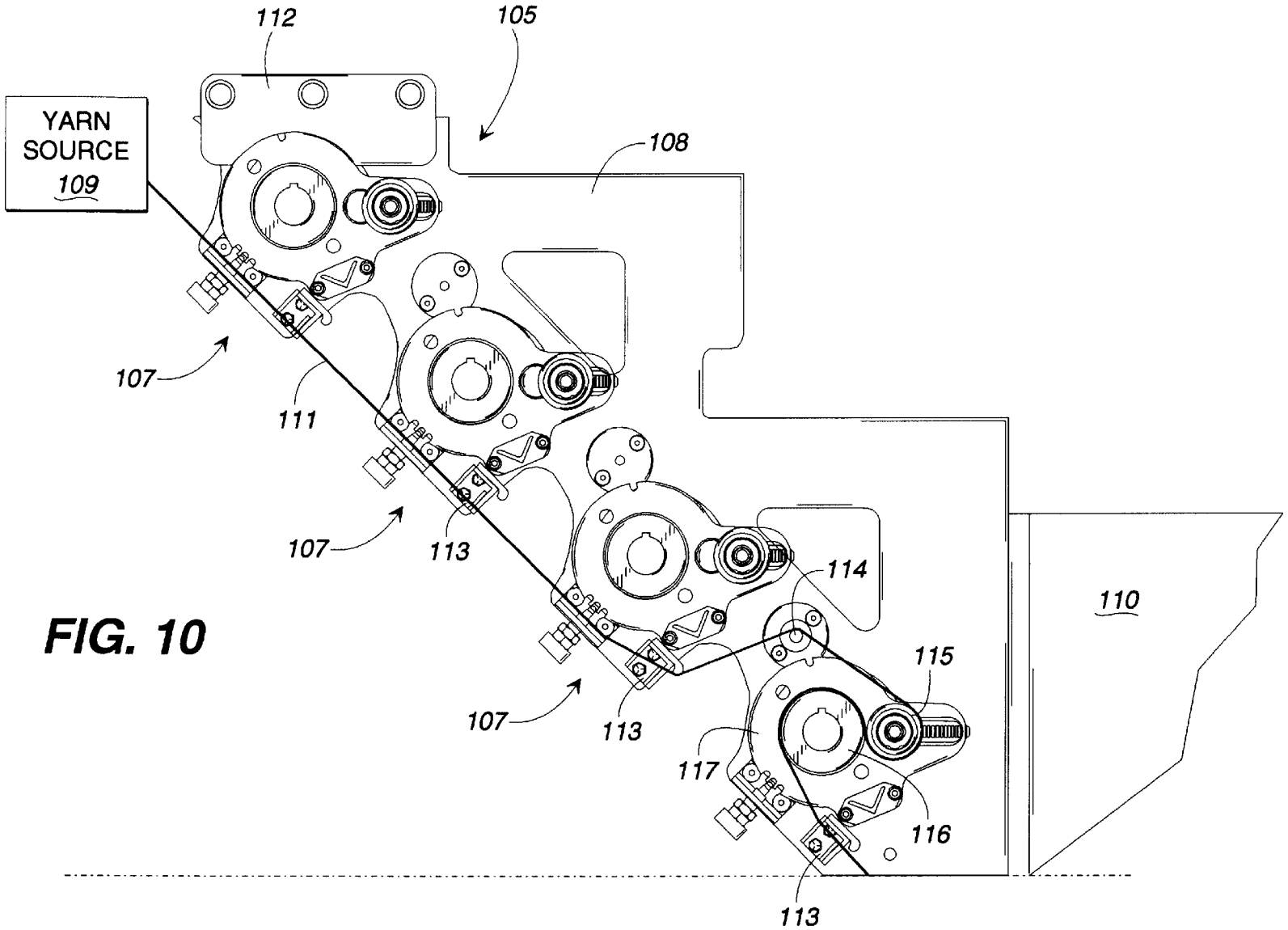
FIG. 10 is an end elevational sectional view of a second embodiment of the pattern yarn feed device of the invention.

A second embodiment of the tufting machine pattern yarn feed device of this invention is illustrated in FIGS. 10–15C. Referring first to FIG. 10, a yarn feed device 105 is illustrated having a spaced series, in this instance four, yarn feed roll assemblies 107 positioned along a common axis (not illustrated) extending upwardly and outwardly away from tufting machine 110. Pattern Yarn feed device 105 may be either a front yarn feed device, or a rear yarn feed device, and is identical in construction and usage in both instances with the two yarn feed devices being mirrored images of the other, i.e., they are in opposite hand. Each one of the yarn feed roll assemblies is supported on a pair of spaced end support brackets or plates 108, one of which is illustrated in FIG. 10, similar in construction and function to support brackets 24, 34 of the first embodiment of the invention, the support brackets being mounted to a side plate (not illustrated) formed as a part of tufting machine 110.

As schematically illustrated in FIG. 10, yarn feed device 105 is supplied with a plurality of yarns 111 from a yarn source 109. A single yarn 111 is illustrated in FIG. 10 for clarity. Yarn 111 extends from yarn source 109 downwardly and inwardly toward tufting machine 110 by being passed through a spaced series of yarn guides 113, and from the yarn guides 113 toward the needle bar (not illustrated) of the tufting machine. In FIG. 10, yarn 111 is also shown as being passed over a yarn idler rod 114 after first being passed through the yarn guides 113 as described above, such that the yarn is passed partially about a pinch roller 115 engaged with a portion of the peripheral surface of a yarn feed roll 116 so that yarn 111 is partially wrapped about the periphery of pinch roller 115, as well as yarn feed roll 116, and then is passed through the last yarn guide 113 illustrated in FIG. 10 and passed toward a yarn puller (not illustrated) similar in construction to yarn puller 33 of FIG. 1.

Still referring to FIG. 10, each one of yarn feed roll assemblies 107 includes a spaced pair of opposed, annular, radially extending indexing plates 117 constructed in fashion similar to indexing plates 60, 61 of the first embodiment of the invention, although only a single indexing plate 117 for each one of the yarn feed roll assemblies is illustrated in FIG. 10 for the purpose of clarity. One of indexing plates 117 is illustrated in greater detail in FIG. 14, in which it is shown that the indexing plate has an annular shaft opening 119 formed centrally within the indexing plate for being passed over the appropriate yarn feed roll shaft (not illustrated) similar to drive roll shafts 38–41 of FIGS. 2 and 9 of the first embodiment of the invention. Defined on the peripheral portion of indexing plate 117 is a first series of radially spaced recesses 120 for holding the pinch roller assembly 133 (FIG. 12) in the yarn applying position, and a radially spaced second recess 121 for positioning indexing plates 117, and pinch roller assembly 133 carried thereon, into the yarn receiving position at the appropriate orbital position about the axis of the yarn feed roll. Recesses 120, 121 thus function in fashion similar to recesses 72 defined in indexing plates 60, 61 of the first embodiment of the invention.

Unlike indexing plates 60, 61, indexing plate, or disc, 117 includes a slotted opening defined within the disc, in which a slidable stub shaft mount is captured by a head cap screw (not illustrated) passed transversely through the periphery of indexing plate 117 with respect to the slot for limiting the travel of the stub shaft mount 124 within slot 123. Stub shaft mount 124 has a groove (not illustrated) defined in the two opposed sides thereof engaged with the side wall of slot 123, each groove being received on a respective one of a pair of opposed and elongate ridges 127 (FIG. 14) formed in the opposed sides of the slot for guiding and retaining stub shaft mount 124 within the slot. A compression spring 128 is passed about a mounting pin 129, the mounting pin being threaded into a peripheral portion of the indexing disc and being passed into a hole (not illustrated) defined in the stub shaft mount so that both the stub shaft mount and spring can freely travel along the mounting pin as pinch roller 115 (FIG. 1) is compressed against yarn feed roll 116 for controlling the yarn feed rate of the yarn wrapped about the pinch roller and the yarn feed roll. The degree of compression exerted by spring 128 against pinch roller 115, and in turn against the yarn feed roll 116 (FIG. 1) may be varied dependent upon which one of recesses 120 locking mechanism 158 (FIG. 12) is received in, and used to lock the indexing disc in position about yarn feed roll 116.

Figure 11:
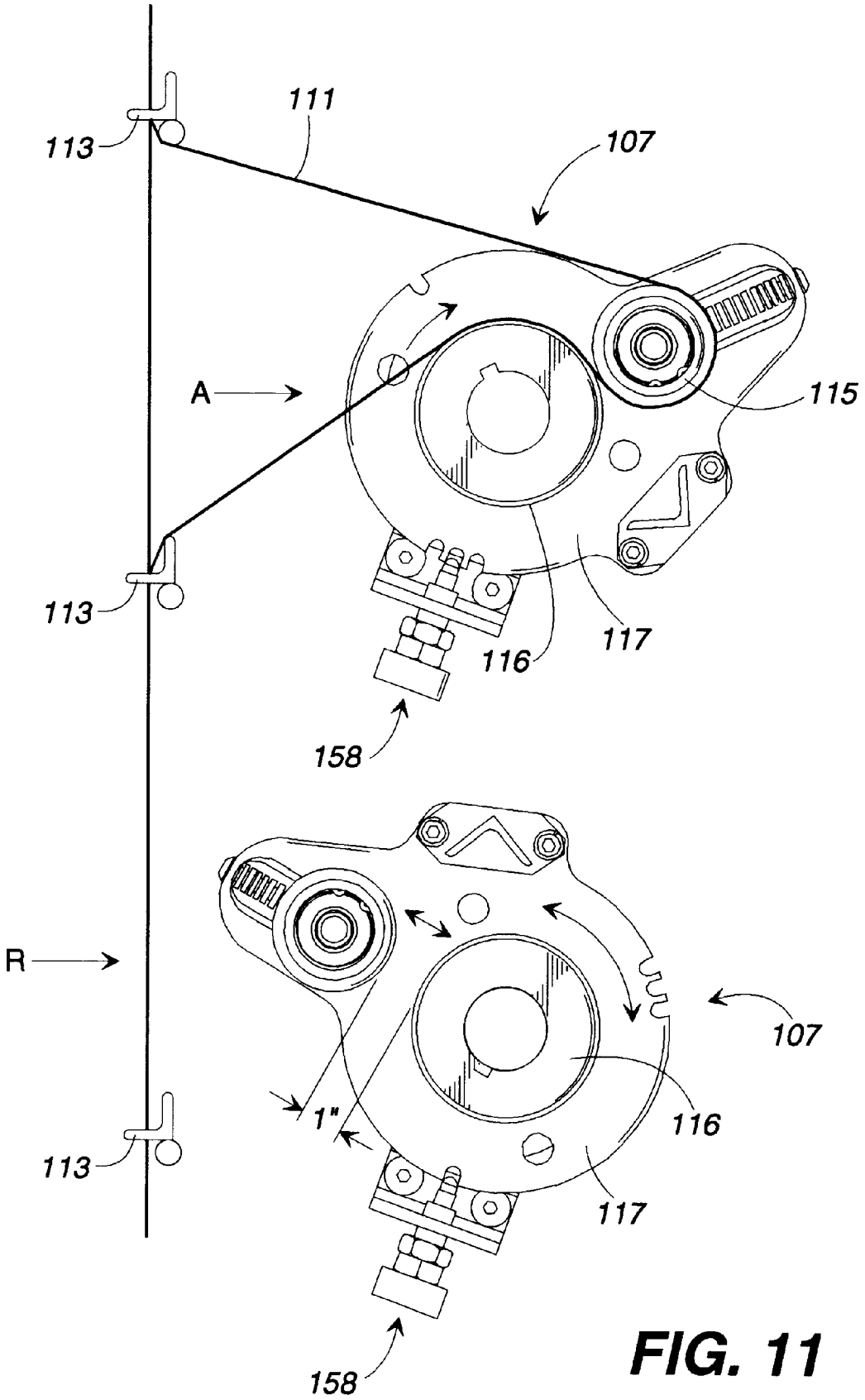
FIG. 11 is a partial end elevational view schematically illustrating two yarn feed roll assemblies of the yarn feed device of FIG. 10 placed in a yarn applying position, and a yarn receiving position, respectively.

As with the yarn feed roll assemblies of the first embodiment of this invention, yarn feed roll assemblies 107 of the second embodiment, and more particularly indexing plates 117, may be rotated so that pinch roller 115 eccentrically moves from a yarn receiving position, designated by the reference character "R" in FIG. 11, into a yarn applying position, designated by the reference character "A" in FIG. 11, for wrapping yarn 111 at least partially about the periphery of a driven yarn feed roll 116. This is also illustrated generally in FIG. 10, in which a yarn 111 is shown being at least partially wrapped about yarn feed roll 116 of the bottom most yarn feed roll assembly closest to tufting machine 110.

Figure 12:
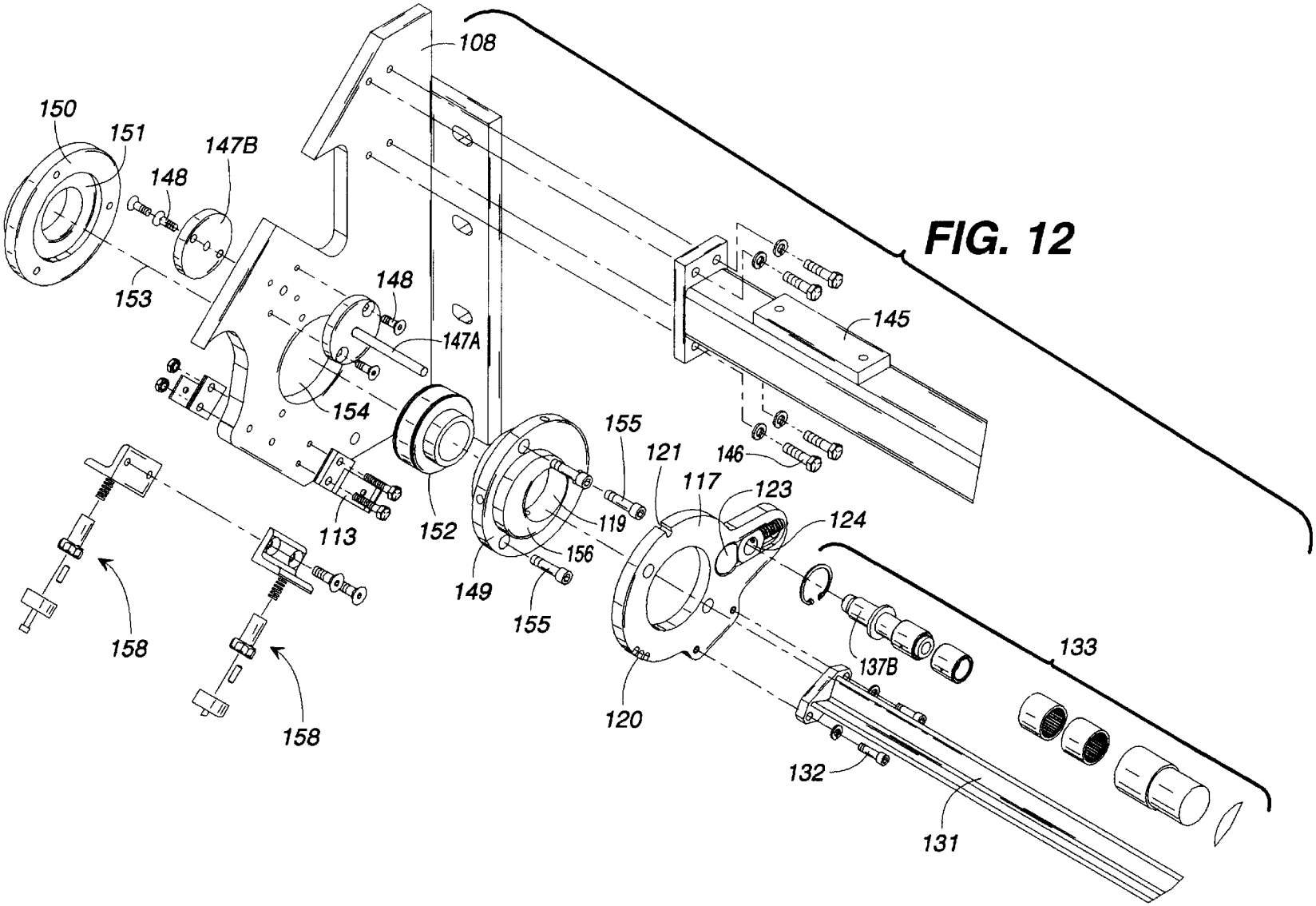
FIG. 12 is a partial fragmentary perspective view detailing the construction of the yarn feed roll assembly of the yarn feed device of FIG. 10.
Figure 13:
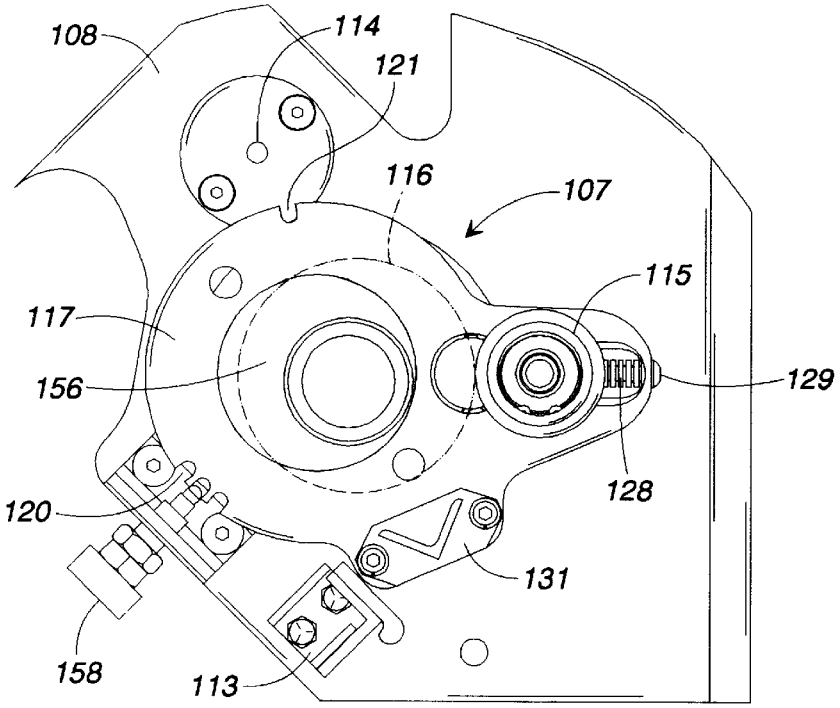
FIG. 13 is a partial end elevational sectional view of a yarn feed roll assembly of the yarn feed device of FIG. 10.

The novel structure of yarn feed roll assemblies 107 which allows for the unique usage of the yarn feed roll assemblies, as shown in FIGS. 10, 11, is illustrated in greater detail in FIG. 12. As shown in FIG. 12, an elongate alignment bar 131, identical in function to alignment bar 73 illustrated in FIGS. 5–8, is fastened to each one of indexing plates 117 so that the indexing plates may be rotated together about the respective ones of the yarn feed rolls 116 (FIG. 13). Alignment bar 131 thus extends parallel to and is spaced from yarn feed roll 116, as illustrated generally in FIG. 13. Alignment bar 131 is comprised of a length of angle iron fastened to a suitable base, the base in turn being fastened to indexing plate 117 with fasteners 132.

Figure 15B:
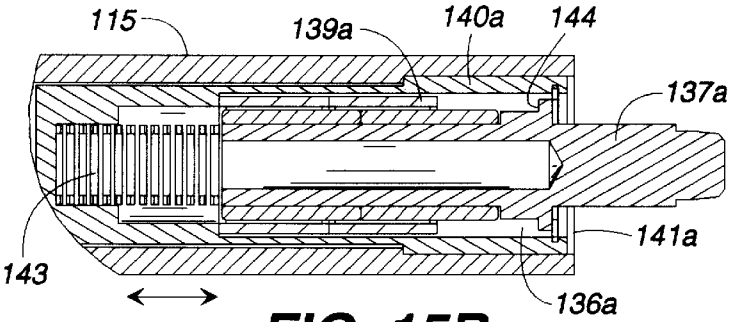
FIG. 15B is a partial side elevational sectional view of the spring loaded stub shaft and journal assembly received in one of the ends of the pinch roller assembly of FIG. 15A.
Figure 15C:
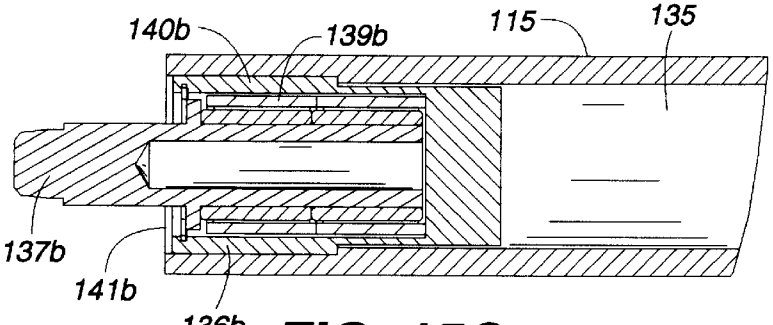
FIG. 15C is a partial side elevational sectional view of the stub shaft and journal assembly received in the other end of the pinch roller assembly of FIG. 15A.
Figure 15A:
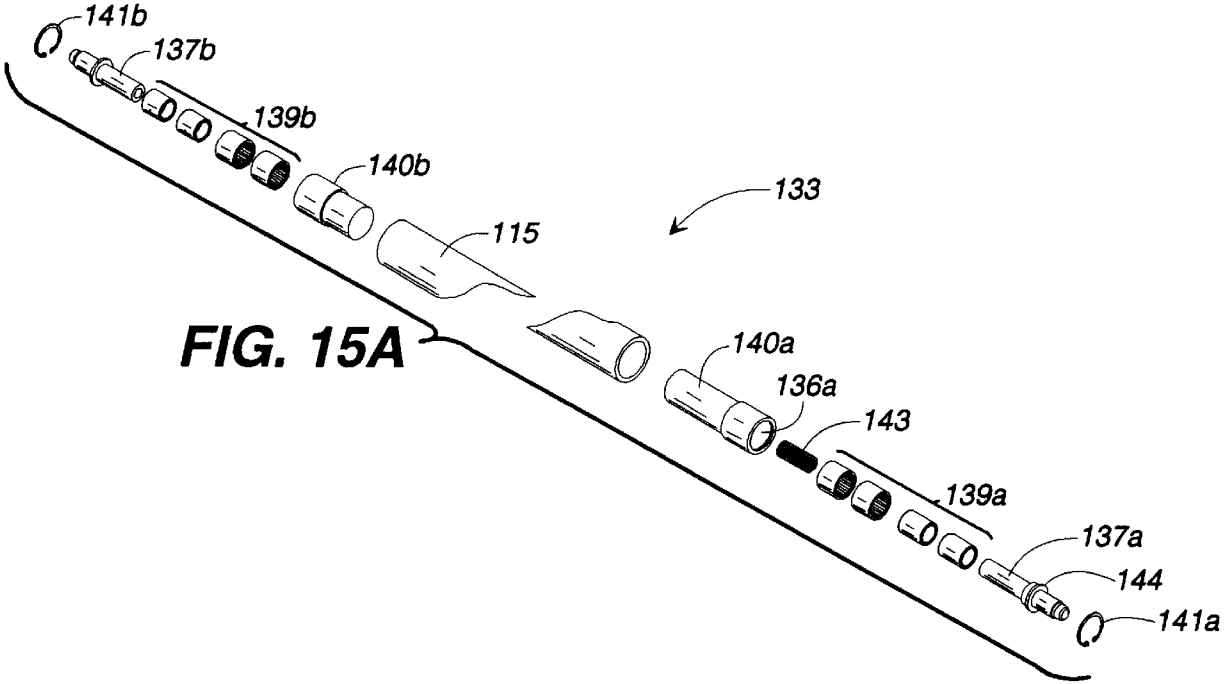
FIG. 15A is a fragmentary perspective view of a pinch roller assembly used with the yarn feed roll assembly of the yarn feed device of FIG. 10.

Still referring to FIG. 12, an elongate stub shaft 137*b*, a part of pinch roller assembly 133, is positioned at the distal end of pinch roller 115 and is received in one of the stub shaft mounts 124. Pinch roller assembly 133 is illustrated in FIGS. 15A through 15C. The pinch roller assembly includes an elongate preferably solid cylindrical pinch roller 115, although the pinch roller could be hollow if so desired. The pinch roller is constructed of a rigid and durable material, preferably a metallic material, for example a polished steel. Although not illustrated in FIGS. 15A–15C, it is anticipated that the periphery of pinch roller 115 could be surface coated with a soft rubber material or a roughened surface, for example a sandpaper, if so desired, although it is preferred that the pinch roller has a smooth surfaced exterior periphery.

Still referring to FIG. 15A, the pinch roller assembly includes a pair of internal axial bores 136*a*, 136*b* defined at the two opposed ends of pinch roller 115, as illustrated more generally in FIGS. 15B and 15C. Received within each one of the respective axial bores is an elongate stub shaft 137*a*, 137*b*, supported for rotation by a journal assembly 139*a*, 139*b*, respectively, housed within respective ones of housings 140*a*, 140*b*. It is anticipated that journal assemblies 139*a*, 139*b* will use needle bearings, although other suitable roller bearings could be used. Each one of the journal assemblies is passed into respective ones of the housings, the housings in turn being retained within the opposed ends of pinch roller 115 by a spring steel retaining ring 141*a*, 141*b*, respectively. As seen in FIGS. 15A and B, stub shaft 137*a* differs from stub shaft 137*b* by being longer, and by being spring loaded by a compression spring 143. As best shown in FIG. 15B, stub shaft 137*a* is passed into journal assembly 139*a* and in turn into housing 140*a*, the entire assembly then being passed into internal axial bore 136*a*, which in the course of so doing compresses compression spring 143 within the internal axial bore with housing 140*a*, which is also passed at least partially over the proximal end of stub shaft 137*a*. Thereafter, retaining ring 141*a* is placed in position at the opening defining axial bore 136*a* in pinch roller 115, whereupon compression spring 143 acts to compress the annular shoulder 144 of stub shaft 137*a* against retaining ring 141*a*. In this fashion, the distal end of stub shaft 137*a* is urged outwardly of pinch roller 115 so that it can be passed into the appropriate one of stub shaft mounts 124 when positioning the pinch roller within the stub shaft mounts of the spaced and opposed indexing plates 117 for orbitally carrying, and rotatably supporting pinch roller assembly 133 thereon.

FIG. 15C illustrates stub shaft 137*b* captively held within internal axial bore 136*b* at the opposed end of pinch roller 115. Stub shaft 137*b* does not reciprocably move within the axial bore, but is instead held in a fixed position. When positioning pinch roller 115 on indexing plates 117, stub shaft 137*b* is placed into one of the two spaced stub shaft mounts 124 held on a respective one of indexing plates 117, while the spring loaded stub shaft 137*a* is pushed inwardly of the axial bore, the pinch roller is then moved into position and is axially aligned with the remaining one of stub shaft mounts 124, and then released so that the stub shaft is urged into and through the stub shaft mount to lock the pinch roller in position onto its associated feed roll assembly 107.

Referring now to FIG. 12, one of support brackets 108 is illustrated, being fastened to a spaced opposite hand support bracket (not illustrated) by one of a spaced series of elongate cross bars 145 which extend parallel to the yarn feed rolls, and transversely across the width of tufting machine 110. Cross bar 145 is fastened to support bracket 108 with a plurality of fasteners 146 in conventional fashion. For the sake of clarity, only a portion of support bracket 108 is illustrated in FIG. 12, the entire support bracket 108 being illustrated in FIG. 10. As with the first embodiment of the invention, a second, spaced, opposed, and parallel support bracket (not illustrated) is provided for supporting the feed roll assemblies 107 thereon, and therebetween.

Also shown in FIG. 12, as well as in FIGS. 10 and 13, is a yarn idler or control rod 114, the yarn idler rod being supported by a base comprised of an inside base portion 147*a*, and an outside base portion 147*b*, which are fastened to one another by a plurality of fasteners 148 so that the two base portions sandwich support bracket 108 therebetween. Yarn idler rod 114 is supported on idler base portions 147*a*, 147*b* so that it remains stationary thereon, and is not supported for rotation. Each of yarn idler rods 114 are constructed in fashion similar to control rods 80, 80*a*, and 80*b*, respectively. Accordingly, the ends of yarn idler rods 114 will include either a spring loaded plunger similar to plunger 86, or notches similar to notches 81, for being received in opposed sockets (not illustrated) formed as part of the spaced and opposed inside yarn idler rod bases 147*a*, respectively.

The respective ones of indexing plates 117 are supported for rotation on support bracket 108 by a pair of hubs, an inside hub 149, and an outside hub 150, fastened to one another so that they sandwich support bracket 108 therebetween in much the same fashion as do idler rod bases 147*a*, 147*b*. However, and as shown in FIG. 12, both inside hub 149 and outside hub 150 include a bearing recess 151, shown only for outside hub 150 in FIG. 12, for receiving a roller bearing assembly 152 therein which in turn rotatably supports yarn feed roll 116 (not illustrated) for rotation about longitudinal axis 153. As shown in FIGS. 12 and 13, however, and unlike indexing plates 60, 61 of the first embodiment of the invention, indexing plates 117 do not concentrically orbit longitudinal axis 153, and thus the yarn feed rolls, rather indexing discs 117 eccentrically orbit longitudinal axis 153 so that pinch roller 115 is moved from the yarn receiving position R to the yarn applying position A, respectively, illustrated in FIG. 11. This is accomplished by the provision of a raised eccentric cam 156 formed on the exterior of inside hub 149 that faces inwardly of support brackets 108, and is positioned outwardly of yarn feed rolls 116, such that indexing plates 117 are received thereon, respectively, by passing the cam/shaft opening 119 defined in the indexing plate over the raised eccentric cam so that the indexing plate slides on the peripheral surface of the eccentric cam, thus imparting an eccentric orbital motion to respective ones of pinch rollers 115 orbited about respective ones of yarn feed rolls 116. It is by this construction, therefore, that the pinch roller may be moved from the yarn receiving position "R" of FIG. 11 to the yarn applying position "A" of FIG. 11 for wrapping individual yarns 111 at least partially about the periphery of respective ones of yarn feed rolls 116.

As illustrated in FIGS. 12 and 13, each indexing plate is provided with a locking mechanism 158, constructed in fashion identical to locking mechanism 70 of the first embodiment of this invention, and thus not described in greater detail herein. The plunger (not illustrated) of the respective ones of locking mechanisms 158 is received in recess 121 for holding the yarn feed assembly in its yarn receiving position, and may be positioned within any one of the three recesses 120 for varying the degree of compression of pinch roller 115 against the periphery of feed roll 116 once the yarn is wrapped partially about the periphery of the yarn feed roll.

The embodiment of pattern yarn feed device 105 illustrated in FIGS. 10 through 15C also has four servomotors (not illustrated) similar to servomotors M1, M2, M3 and M4 illustrated in FIGS. 2 and 9, for separately driving the respective yarn feed rolls 116 independently of one another, a separate servomotor being provided as a part of each respective one of the yarn feed roll assemblies 107. As with the first embodiment of the invention, however, conventional electric motors, or any other type of suitable motor, may be used to rotate the respective yarn feed rolls. A computer or control processor will be used to operate these four servomotors, which computer or control processor may comprise a portion of the computer controlled tufting machine and process disclosed in U.S. Pat. Nos. 4,867,080, 4,981,091, and 5,005,498 to Taylor, et al. Pattern yarn feed device 105 also include four drive shafts (not illustrated) the equal of drive shafts 36 and 37 illustrated in FIG. 2, and four gear reducers (not illustrated) similar to gear reducers R1, R2, R3 and R4, respectively. These drive shafts will in turn drive the roll shafts (not illustrated) for each one of yarn feed rolls 116 through conventional drive trains (not illustrated) housed within suitable protective covers (not illustrated) similar to covers 36*a* and 37*a* of FIG. 2. Each one of these drive trains may therefore include a sheave (not illustrated), such as sheave 28 (FIG. 1), a sprocket (not illustrated), or a drive gear (not illustrated) driving an endless timing belt (not illustrated), such as belt 28*a*, a drive chain (not illustrated), or a mechanical gear train (not illustrated), respectively, which in turn rotates the respective yarn feed roll shafts. Hence, the four servomotors control and drive the four yarn feed rolls 116 of the second embodiment of yarn feed device 105.

Figure 16A:
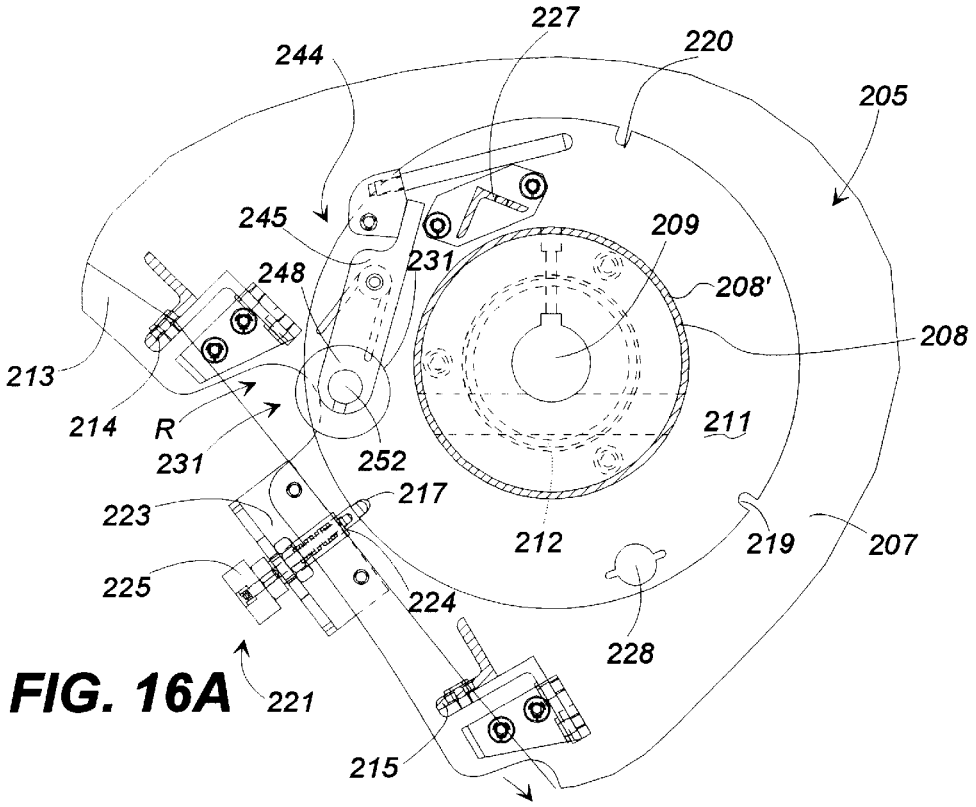
FIGS. 16A–16H are sequential vertical sectional views of a third embodiment of the pattern yarn feed device of this invention, illustrating the progressive wrapping of a yarn about a yarn feed roll, and using a second pinch roller construction to selectively pinch the yarn against the periphery of its associated yarn feed roll.
Figure 16B:
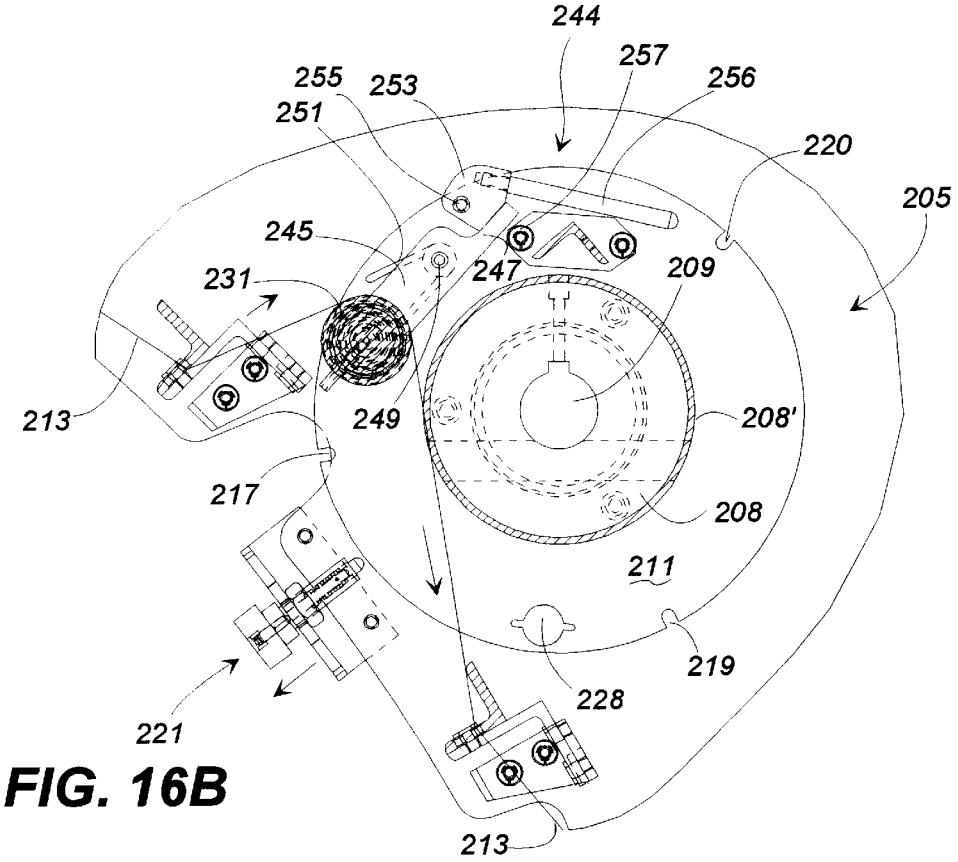
Figure 16C:
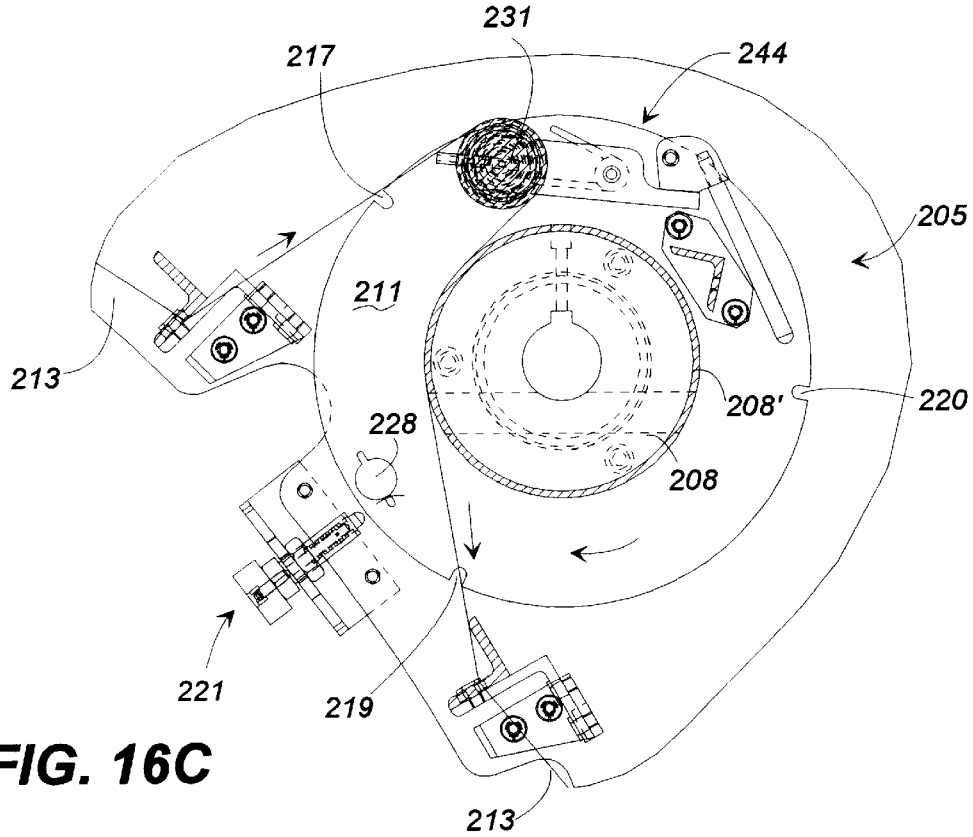
Figure 16D:
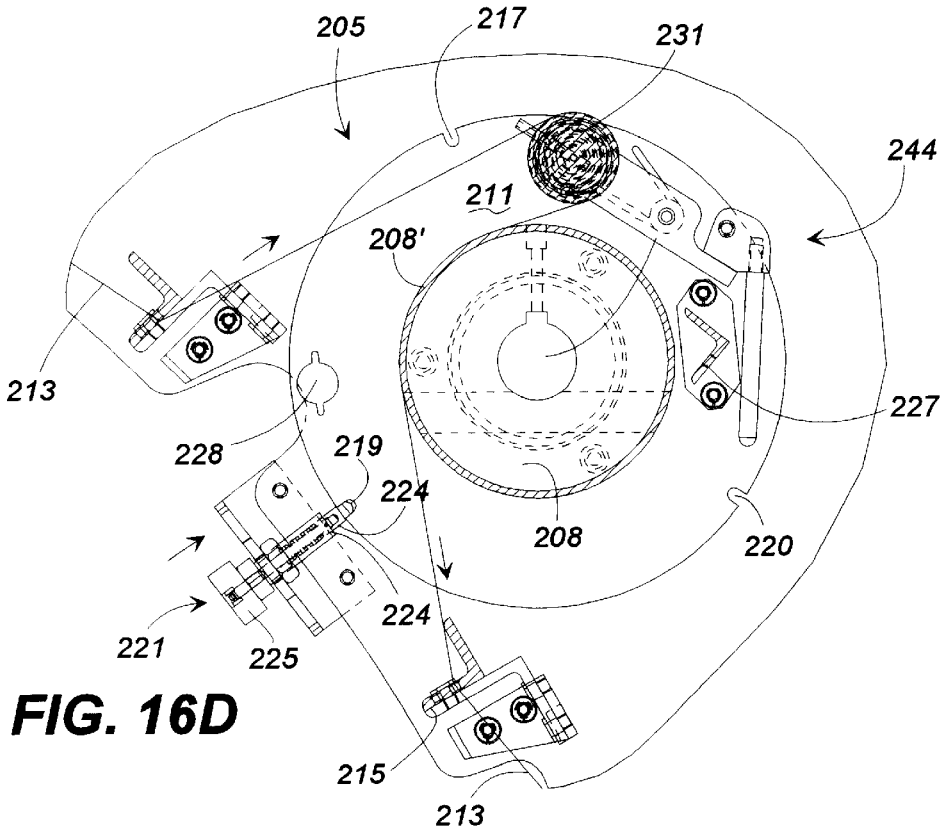
Figure 16E:
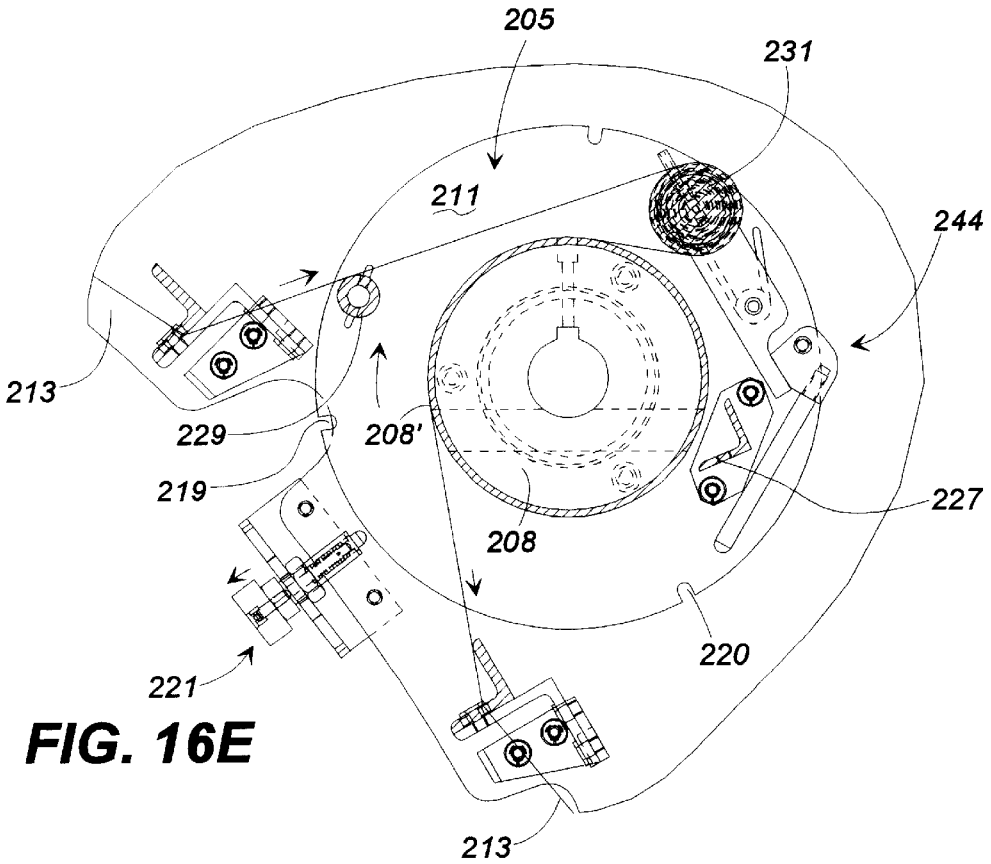
Figure 16F:
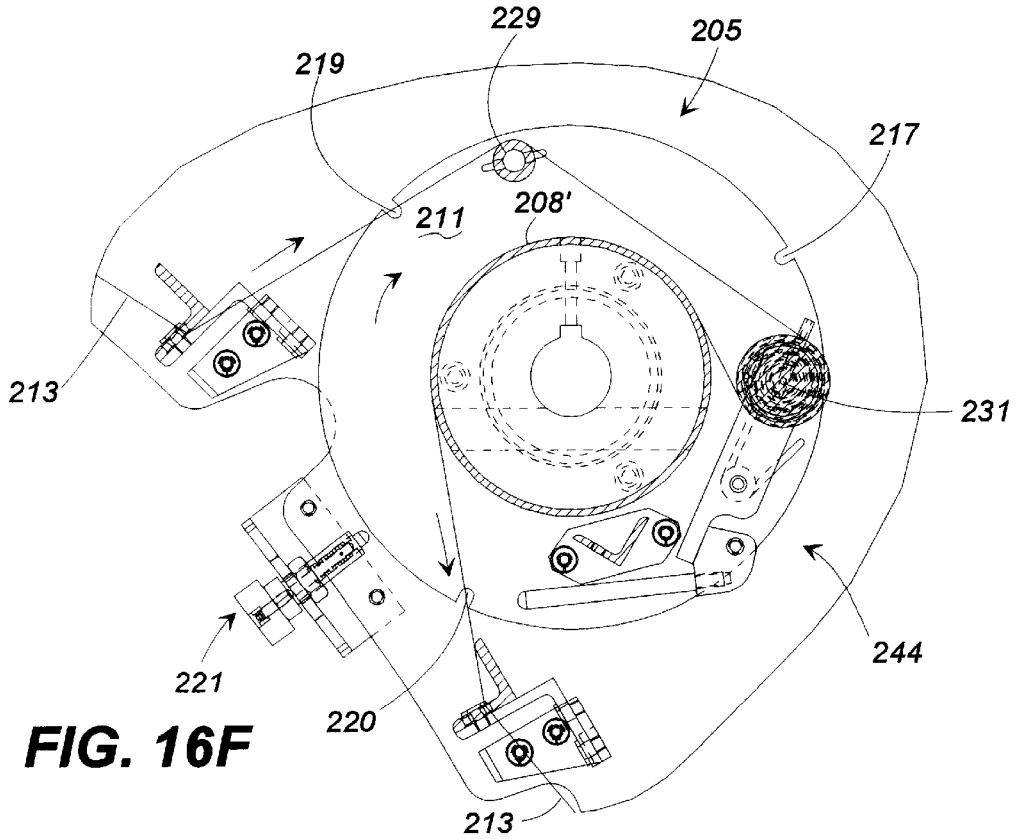
Figure 16G:
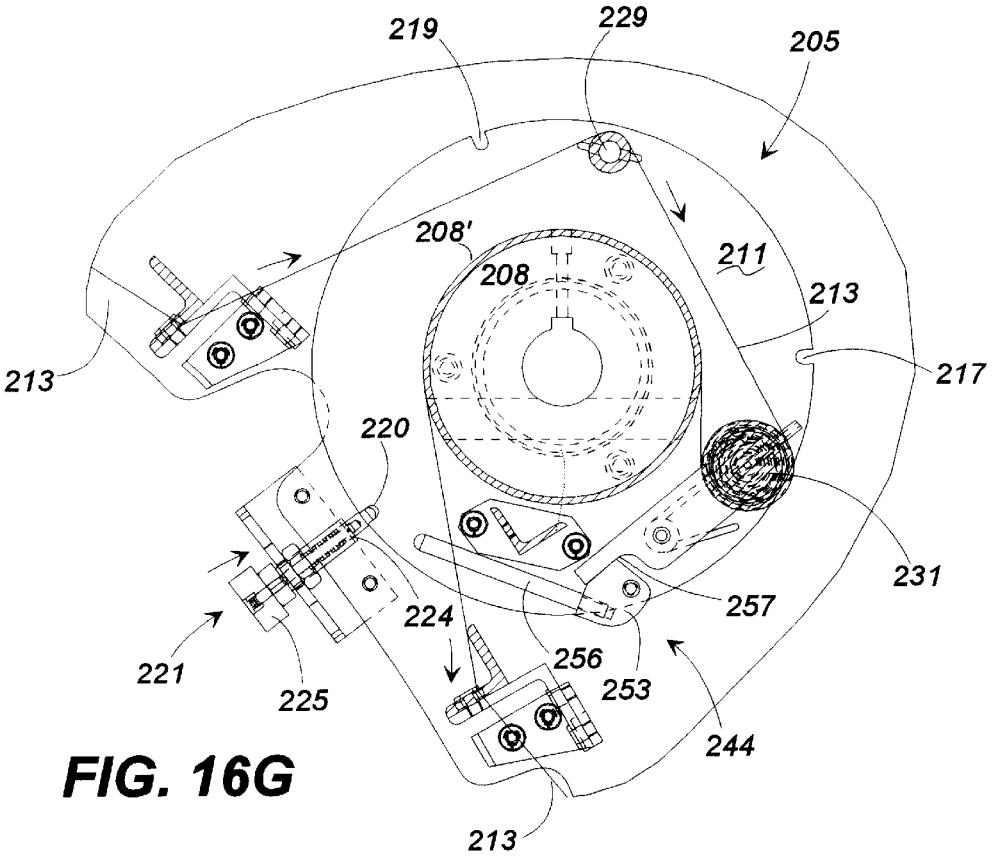
Figure 16H:
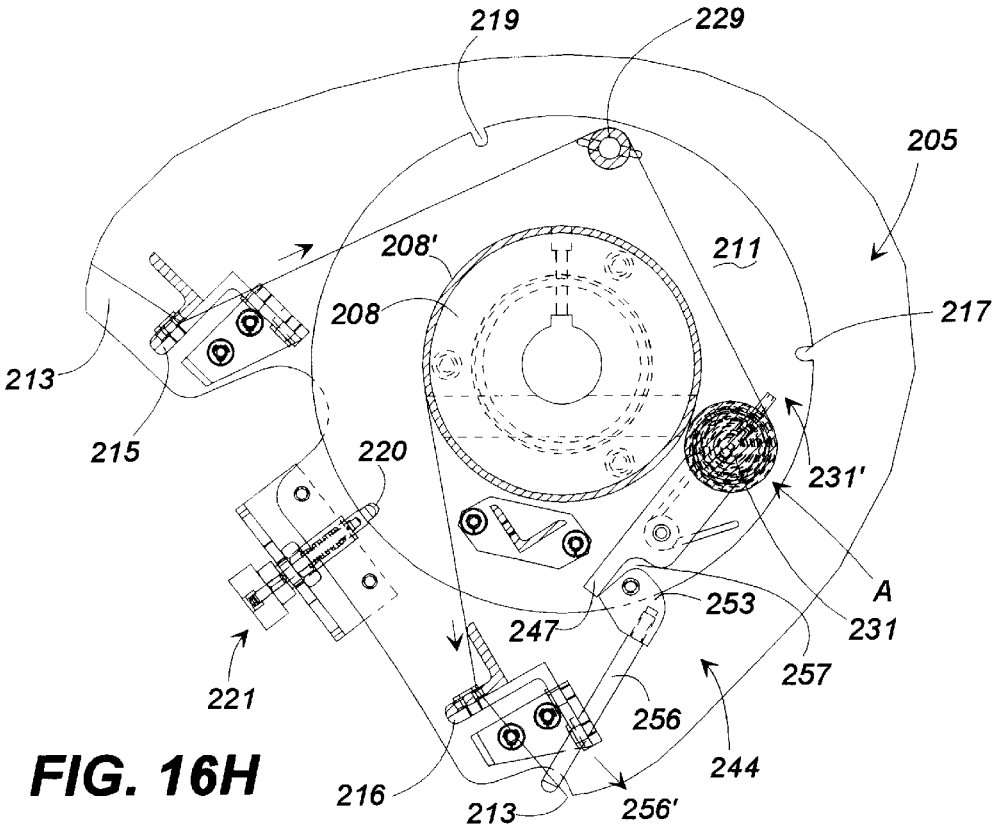
Figures 17A, 17B:
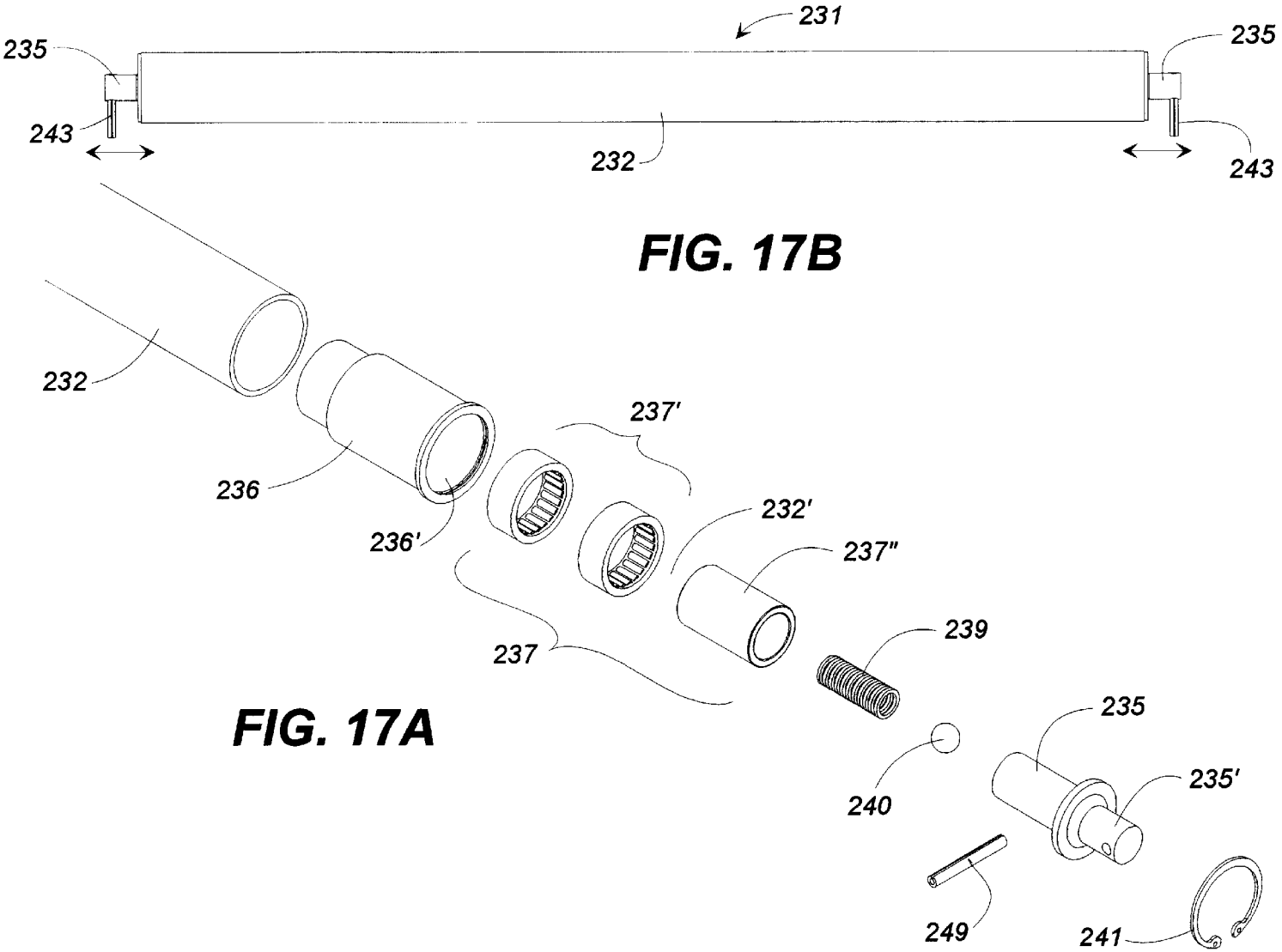
FIG. 17A is a fragmentary partial perspective view of the pinch roller illustrated in FIGS. 16A–H.
FIG. 17B is a side elevational view of the pinch roller illustrated in FIGS. 16A–K.

A third embodiment of yarn feed assembly 205 used in the pattern yarn feed device of this invention is illustrated in FIGS. 16A–H, as well as in FIGS. 17A and B. Referring first to FIG. 16A, a yarn feed roll assembly 205 is illustrated which is supported on the end support bracket 207 of an otherwise conventional tufting machine, as shown for example in FIG. 1. The yarn feed roll assembly includes an elongate rotatable yarn feed roll 208 formed about a shaft 209. The ends of shaft 209 extend through one of a pair of opposed indexing discs or plates 211, one of which is shown in FIGS. 16A–16H, each indexing disc 211 being constructed in fashion identical to the indexing discs 60, 61 and 117, described hereinabove. Accordingly, each indexing disc 211 is rotatably supported on a hub 212, shown in broken lines in FIG. 16A, the hub including a roller bearing assembly for rotatably journaling the ends of shaft 209 such that the yarn feed roll rotates about its longitudinal axis extending through the center line of shaft 209. Although not illustrated in FIGS. 16A–16H, feed roll 208 is rotatably powered by a drive motor, preferably a servomotor, as described hereinabove. It is understood, however, that the respective yarn feed rolls of the various embodiments of the pattern yarn feed device of this invention may be powered by conventional AC or DC motors, for example a stepper motor, or could even be geared in some fashion to the rotation of the tufting machine main drive shaft using a series of clutches for selectively rotating the feed rolls in timed relationship with the rotation of the tufting machine main drive shaft, and thus the reciprocation of the needles to which the threads are extended.

A continuous tufting yarn 213 extends along a yarn feed path to which the yarn feed roll assembly 205 is adjacent, the tufting yarn passing through a first yarn guide 215 and a second yarn guide 216. The yarn feed path extends downward and along the yarn feed roll assembly toward the needles supported on the needle bar of the tufting machine, in fashion described hereinabove. Moreover, although only one yarn feed roll assembly 205 is shown in FIGS. 16A–16H, it is anticipated that a spaced series of such yarn feed roll assemblies could be provided, in much the same fashion as is shown in FIGS. 1 and 10. In such a configuration, it is anticipated that the yarn feed roll assemblies 205 will extend upwardly and away from the frame of the tufting machine, and can either extend upwardly along a vertical line, outwardly along a horizontal line with respect to the frame, or along an arcuate line as shown in FIG. 1, and with an easy reach of the machine operator or machine technicians either operating the tufting machine, or servicing the yarn feed roll assemblies, respectively.

A radially spaced series of recesses 217, 219, 220 are defined in the circumference of indexing discs 211, and define selected positions about the axis of the yarn feed roll such that the indexing disc 211 can be rotated about the axis of the yarn feed roll, independently of the rotation of the yarn feed roll, for selectively positioning pinch roller 231 and/or control rod 229 of this construction of the yarn feed roll assembly. The indexing discs are held in their respective positions about the axis of the yarn feed roll by a locking mechanism 221 constructed and arranged to be yieldably urged into one of the three recesses 217, 219, 220, for locking the indexing discs in position about the yarn feed roll. Locking mechanism 221 includes, therefore, a mounting bracket 223 fastened to end support bracket 207 of the tufting machine, a spring-loaded plunger 224 constructed and arranged to be reciprocably urged into engagement with one of the three recesses, and a head 225 which can be grasped for withdrawing the plunger backward against the bias of the spring (not illustrated) of the plunger, and which may also be threaded for locking the plunger in its extended position, as shown in FIG. 16A, or in its retracted position, for example as shown in FIG. 16B. Locking mechanism 221 is constructed in the same fashion as is the locking mechanism 70, and the locking mechanism 158 of the first two embodiments of this invention, described in greater detail hereinabove.

Indexing disc 211 is journaled on the exterior of hub 212 in much the same fashion as is indexing disc 117 of FIGS. 10–15C, and more particularly as shown in the exploded perspective view of FIG. 12 in which it is seen that indexing disc 117 rides on the exterior surface of eccentric cam 156 formed as a part of hub 149, 150. In this third embodiment of the invention, indexing disc 211 rides concentrically about the axis of yarn feed roll 208 on a raised surface (not illustrated) formed as a part of the hub 212, such that there is no eccentric motion imparted to the orbit of controller 231 about yarn feed roll 208.

An elongate alignment bar 227, typically a piece of angle iron, extends between the two opposed indexing discs 211, and is fastened thereto such that the two indexing discs and the alignment bar form a solid structure, whereby the indexing discs can be rotated concentrically about the axis of the yarn feed roll through an identical degree of angular rotation by grasping alignment bar 227 and manually rotating the indexing discs through the desired angular range, typically those angular positions defined by recesses 217, 219, and 220, although additional recesses may be defined within the circumference of the indexing discs, as is shown, for example, with indexing plate 117 of FIGS. 10 and 11, in which a closely spaced series of recesses 120 are defined for varying the angular degree of yarn wrap about the yarn driving periphery of the yarn feed roll.

The two opposed indexing discs are also "fastened" to one another through the use of an elongate hollow control rod, similar to the manner in which the control rods 80, 80*a*, and 80*b* of FIGS. 1–9 are used, not only for holding the yarn away from the yarn driving periphery of the yarn feed roll, but also for adding structural rigidity to the alignment bar and two indexing discs. Accordingly, a pair of opposed sockets, one of which, socket 228, is illustrated in indexing disc 211, are defined in each of the indexing discs and are aligned with one another such that an elongate hollow control rod 229 may be passed therein. Socket 228 is constructed in the same fashion as are the sockets for use with control rods 80–80*b*, and thus one of the sockets has an elongate pin extending along the diameter and across the opening of the socket for receiving a pair of slots formed in one end of the control rod, whereas the other end of the control rod has a spring-loaded shaft for being fit within an opposed socket (not illustrated) which does not have a pin therein, such that the control rods can be yieldably moved into and out of engagement with the sockets for being removed and replaced when, and as desired, during the usage of the pattern yarn feed device, and more particularly when the amount of yarn wrap about the yarn driving periphery 208' of yarn feed roll 208 is varied, as shown in FIGS. 16A–H. Although only one control rod 229 is shown in FIGS. 16A–H, it is anticipated that a radially, or circumferentially, spaced series of control rods 229 could be provided in much the same fashion as are control rods 80–80*b* of FIGS. 1–9.

In this third embodiment of the yarn feed roll assembly 205, a pinch roller 231 is provided which resembles at first blush the pinch roller 135 of FIGS. 10–15, however rather than being constructed to be eccentrically orbited from a yarn receiving position "R" (FIG. 16A) into a yarn applying position "A" (FIG. 16H) against at least a portion of the yarn driving periphery of the yarn feed roll, pinch roller 231 is constructed and arranged to be concentrically orbited about the axis of the yarn feed roll, and is selectively moveable into a yarn applying position when, and as desired, should it even be desired to engage the pinch roller upon the yarn driving periphery 208' of the yarn feed roll. The construction of pinch roller 231 is illustrated in greater detail in FIGS. 17A and 17B. Turning first to FIG. 17A, pinch roller 231 includes an elongate tubular pinch roll 232 having an identical stub shaft 235 positioned at each one of its ends for journaling the rotation of the pinch roll. Each of stub shafts 235 is spring-loaded in much the same fashion as is pinch roller 135 of FIGS. 15A–15C. However, pinch roller 135 has a fixed or stationary stub shaft 137*b* and a spring-loaded stub shaft 137*a*, which construction may also be used with pinch roll 232 if so desired, although for the reasons described in greater detail below, it is anticipated that both of the stub shafts 235 used with pinch roller 232 will be spring-loaded.

The construction of the spring-loaded stub shafts of the pinch roller 231 is illustrated in FIG. 17A in which it is shown that pinch roll 232 is an elongate hollow tube extending along longitudinal axis 232'. A hollow annular shaft housing 236 is provided which is sized and shaped to be fit within one of the ends of pinch roll 232. Received within the shaft housing is a bearing assembly 237, which is comprised of a pair of roller bearings, typically needle bearings 237', and a cylindrical inner race 237" which is constructed and arranged to receive stub shaft 235 therein. Passed within the inner race is a compression spring 239, which bears against a flat surface defined within shaft housing 236, which is counter-bored as shown at 236', and bears at its other end against a ball bearing 240, the ball bearing in turn bearing against the end of stub shaft 235 such that as the pinch roller rotates, and/or as the stub shafts rotate, that should for some reason one become bound with respect to the other, the spring will rotate on ball bearing 240 to ensure that the spring-loaded construction of the stub shaft is not damaged or destroyed during operation of the tufting machine. By making each one of stub shafts 235 spring-loaded at the opposed ends of pinch roll 232, it is anticipated that the stub shafts will act to center the pinch roll on the carrier arms to ensure that the pinch roll does not otherwise bind or become engaged with the carrier arms which might result in the binding of the pinch roll, and which would tend to snap or break the selected ones of the yarns 213 passed thereover and applied to yarn feed roll 208.

Stub shaft 235 has an annular flange 235' formed as a part thereof, and which is retained within shaft housing 236 by retaining ring 241. The retaining ring is received within an annular groove (not illustrated) defined within the annular opening of counter-bore 236', such that each of stub shafts 235 can be reciprocably moved along longitudinal axis 232', as shown generally in FIG. 17B. Each of stub shafts 235 includes a circular opening (not illustrated) drilled within that portion of the stub shaft extending outwardly of shaft housing 236, and into which a split pin 249 is received such that a machine operator or technician can manually urge each one, or both, of stub shafts 235 inwardly against the bias of compression spring 239 for releasing the pinch roller from the yarn feed roll assembly when it is desired to thread the pinch roller through selected ones of the yarns to be fed to selected ones of the tufting needles, and/or when it may become necessary to remove, repair, and/or replace the pinch roller.

Pinch roller 231 is selectively moveable from a yarn receiving position, denoted by the reference character "R" in FIG. 16A, into a yarn applying position, denoted by the reference character "A" in FIG. 16H, through the use of a spring-loaded cam mechanism 244, illustrated in FIGS. 16A–H, and illustrated in greater detail in FIG. 16B. Referring now to FIGS. 16A and 16B, a carrier arm 245 is pivotally affixed to each one of the opposed indexing discs 211, the two carrier arms being mirrored images or opposites of one another such that they are facing toward one another and opposed from one another for rotatably journaling pinch roller 231 thereon. Each carrier arm 245 therefore has a proximal end 247, and a distal end 248. A pin 249 positioned intermediate the proximal and distal ends of the carrier arm is affixed to the respective indexing discs 211, and forms the pivot point about which the carrier arms 245 pivot between the yarn receiving and yarn applying positions. Each carrier arm 245 is provided with a spring 251 which acts to normally and resiliently urge the carrier arm, and thus the pinch roller 231, into engagement with at least a portion of the yarn driving periphery 208' of yarn feed roll 208.

As shown in FIG. 16A, an annular opening 252 is defined at the distal end of carrier arm 245, and is sized and shaped to receive one of stub shafts 235 of the pinch roller therein. As the stub shafts are provided with a bearing assembly 237 for rotatably supporting or journaling the pinch roller 232, it is anticipated that stub shafts 235 will not be rotatably received within openings 252, and thus no bearings are provided within opening 252. However, and if so desired, the construction of carrier arms 245 could be modified such that a roller bearing or other suitable bearing assemblies provided at opening 252.

An actuating cam 253 is pivotally affixed to indexing discs 211 by a pin 255, such that the cam rotates about the pin for acting on carrier arm 245. This is accomplished through the manipulation of an elongate lever arm 256 which is affixed to cam 253, such that the movement of lever arm 256, as shown for example in FIG. 16H, moves actuating cam 253 on a camming surface 257 defined on the proximal end 247 of carrier arm 245, such that the normal bias of spring 251 is allowed to act for normally and resiliently urging the carrier arms, and thus pinch roller 232, toward the yarn driving periphery of the yarn feed roll. When lever arm 256 is moved toward the yarn feed roll 208, as shown in FIG. 16A for example, then actuating cam 253 bears against camming surface 257 for compressing spring 251, and moves the carrier arms, and thus pinch roller 231 into its yarn receiving position such that the pinch roller is not engaged with any portion of the yarn driving periphery of the yarn feed roll. It is anticipated that pinch roller 231 could thus be used as a control rod for progressively wrapping yarn 213 about the yarn driving periphery of yarn feed roll 208, as shown in FIGS. 16A–16G, without the need to engage the pinch roller on the yarn driving periphery of the yarn feed roll. However, in order to attain greater, i.e. more positive, control of the yarn, it is preferred that lever arms 256 be moved such that actuating cam 253 releases the tension of spring 251, to allow pinch roller 231 to be yieldably urged into engagement with the yarn driving periphery 208' of yarn feed roll 208 to compress the selected ones of the yarns against the yarn driving periphery, such that the sandpapered surface of yarn feed roll 208 "bites" into the yarns when starting their feed toward the needles 15, 16 (FIG. 1) situated on needle bars 14*a*, 14*b* (FIG. 1).

In a fashion similar to the embodiment of the invention illustrated in FIGS. 1–9, therefore, the pinch roller 231 and control rod 229 are concentrically orbited about yarn feed roll 208, rather than using the eccentric orbit of the second embodiment of the invention illustrated in FIGS. 11–15C. However, as with the second embodiment of the invention shown in FIGS. 11–15C, and in particular through the use of pinch roller 135, pinch roller 231 can be selectively moved into engagement with the yarn driving periphery 208' of yarn feed roll 208 such that the pinch roller compresses selected ones of the yarns thereagainst for more positively controlling the yarns. The yarn feed roll assembly 205 illustrated in FIGS. 16A–17B, therefore, combines features of the first two embodiments of the invention disclosed in FIGS. 1–15C.

OPERATION

Figure 5:
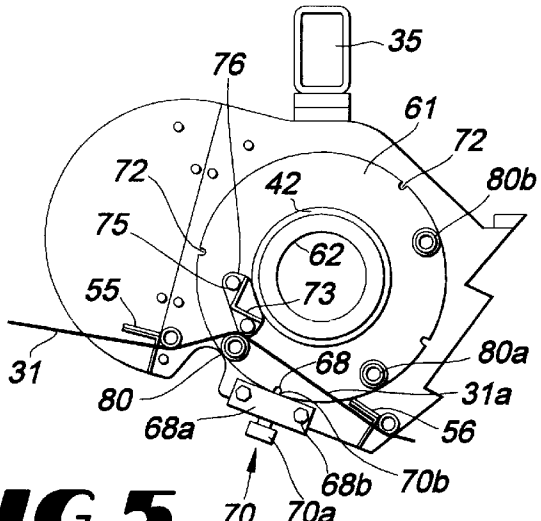
FIG. 5 is a first sequential vertical sectional view of a portion of the yarn feed roll assembly of FIG. 2 showing the indexing disc and control rods of an indexing assembly for one of the yarn feed roll assemblies in an initial position with a yarn passed over one of the control rods thereof.
Figure 7:
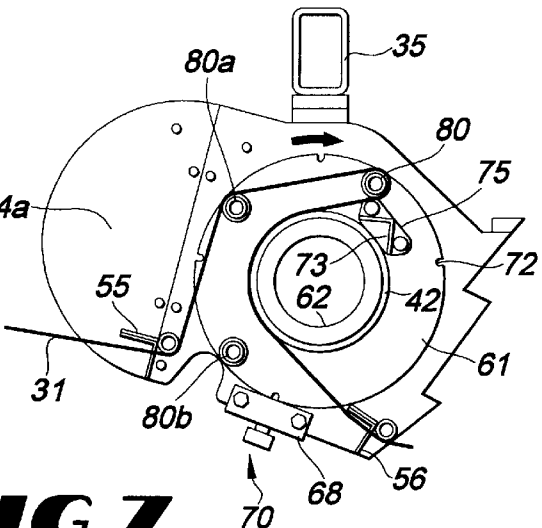
FIG. 7 is a third sequential view similar to FIG. 5 showing the indexing assembly rotated approximately 180° from its initial position.

When it is desired to cause certain of the yarns to be controlled by a prescribed yarn feed roll, such as yarn feed roll 42 for example, the locking mechanisms 70 for the indexing plates 60 and 61 are released. This is accomplished by rotating threaded heads 71*a* so as to allow plungers 70*b* to be urged from recesses 72 in order to permit the rotation of indexing plates 60, 61. As a part of this process, alignment bar 73 (FIGS. 5 to 8) is manually grasped after the locking mechanisms are released, and the indexing plates are simultaneously rotated together, by rotating the alignment bar about the axis of the yarn feed roll so that indexing plate 61 may be moved from its initial home or yarn receiving position, as shown in FIG. 5. In the yarn receiving position of FIG. 5, none of yarns 31 yet contact a portion of the periphery of yarn feed roll 42. Thereafter, control rod 80 is removed from between the plates 60, 61, as described hereinabove, and selectively passed between the increments of selected ones of yarns 31 and the remaining ones of yarns 31, as illustrated generally in FIGS. 2 and 9. When the selected (pre-determined) group of yarns 31 has been collected on yarn control rod 80, the rod is then replaced in its sockets, shown in FIG. 5. As control rod 80 is subsequently rotated or orbited (FIGS. 5, 6) about the axis of yarn feed roll 42, the control rod will draw an intermediate portion 31*a* of the yarns 31 sideways and upwardly away from the path of the yarn through yarn guides 55 and 56, and away from the remaining yarns of the yarn blanket.

Figure 6:
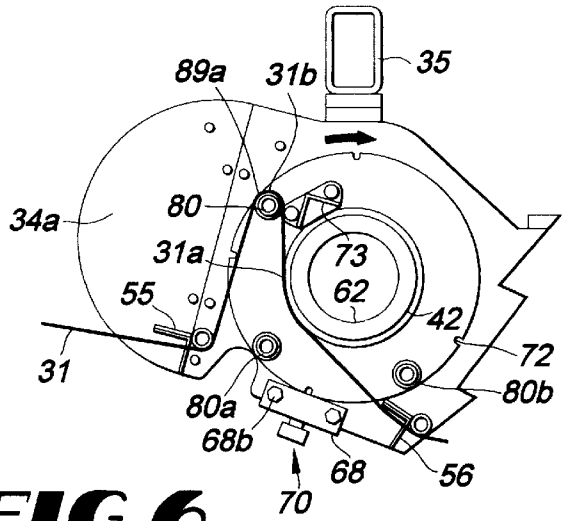
FIG. 6 is a second sequential view similar to FIG. 5 showing the indexing assembly rotated approximately 90° from its initial position.

Referring generally now to FIG. 6, after control rod 80 has been reinstalled between indexing plates 60 and 61, control rod 80*a* is then temporarily removed from between the indexing plates, whereupon indexing plates 60, 61 are rotated together through an approximate 90° arc. As the indexing plates are being moved, however, the plungers 70*b* of locking mechanisms 70 are pushed downwardly by the peripheries of the indexing plates so that the plungers 70*b* are forced inwardly of the locking mechanism and out of the notches or recesses 72 in which the plungers were earlier retained, the plungers being subsequently urged by their respective compression springs into a successive pair of recesses 72, as shown in FIG. 6, when indexing plates 60, 61 reach the approximate 90° rotational position shown therein.

As seen in FIG. 6, control rod 80 forms a yarn bight 31*b* in which yarn 31 extends partially about a portion of the control rod for urging the yarn increments 31*a* into engagement with an initial peripheral portion of yarn feed roll 42 as the indexing discs are rotated through the 90° arc. Control rod 80*a* is then repositioned in its sockets between the indexing plates so as to be positioned outwardly of yarn increment 31*a* held against the exterior of yarn feed roll 42. Control rod 80*b* is next removed from between indexing plates 60, 61 whereupon the indexing plates are once again manually rotated through an additional 90° arc to the approximate 180° position illustrated in FIG. 7. Control rod 80*b* is then placed back into its mounting sockets (not illustrated) in its original position on the indexing discs. Control rod 80 has therefore rotated yarn bight 31*b* from the 90° position of FIG. 6 to the 180° position of FIG. 7, and has carried the intermediate portion 31*a* of the yarn 31 progressively further around the periphery of yarn feed roll 42, so that the yarn now circumscribes approximately 160° of the exterior periphery of the yarn feed roll.

Figure 8:
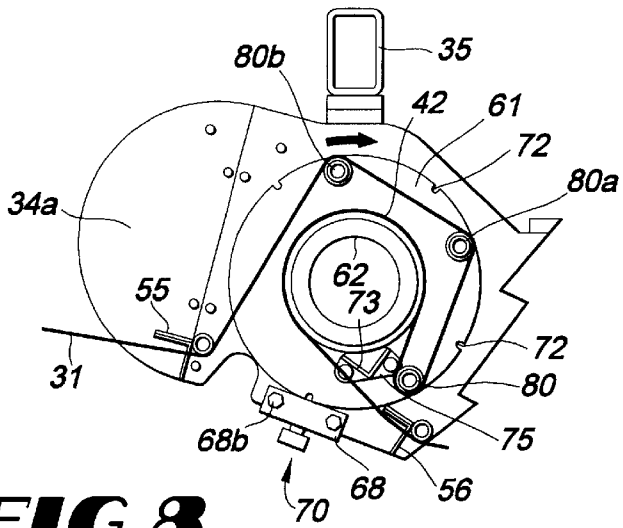
FIG. 8 is a fourth sequential view similar to FIG. 5 showing the indexing assembly rotated approximately 270° from its initial position.

Thereafter, indexing plates 60, 61 are once again rotated through an arc of approximately 90° to the approximate 270° position of indexing plate 61 illustrated in FIG. 8. In FIG. 8 the operating position of the yarn feed roll is illustrated in which the yarn 31 travels first over and partially around control rod 80 then around approximately 270° of the exterior periphery of yarn feed roll 42. The yarns 31 which are to be selectively controlled by yarn feed roll 42 are, therefore, moved out of their "normal" paths, i.e. their straight paths through yarn guides 55,56, in which the upstream, the deviated, portions of the yarns 31 initially pass around control rod 80 and beneath control rods 80*a* and 80*b*, respectively, looping over less than the entire circumference of yarn feed roll 42, and then pass from under that portion of the periphery of the yarn feed roll with which the yarn is engaged toward and through yarn guide 56, and thence, along essentially parallel paths to the needles 16 as illustrated generally in FIGS. 1, 2, and 9.

Once the indexing plates are in the yarn applying position shown in FIG. 8, the locking mechanisms 70 are tightened so as to force plungers 71*b* into the appropriate ones of recesses 72 (FIG. 8) to lock indexing plates 60, 61 in the yarn applying position, rotated approximately 270° from the yarn receiving position of FIG. 5. In like fashion, the remaining yarn feed rolls 43, 44 and 45 of the front pattern yarn feed device, as well as the yarn feed rolls of the rear pattern yarn feed device, may be provided with selected increments from different yarns 31, 21, respectively, so that all of the respective yarns of the yarn blanket(s) contact only one selected yarn feed roll.

If it is desired to alter the feeding arrangement of yarn 31 with respect to yarn feed rolls 42, 43, 44 and 45 of FIGS. 5 to 8, the appropriate opposed pairs of indexing plates 60, 61 are rotated back to their original or yarn receiving positions as shown for plate 61, in FIG. 5, and control rods 80, 80*a* and 80*b*, are removed, replaced, and rotated as appropriate, in reverse of the procedure described above. Thereafter, different selected yarn segments or increments, such as increment 31*a* of FIGS. 5 to 8, can be removed from the yarn blanket and applied to a selected yarn feed roll without re-threading needles 16, thus reducing to a minimum the manpower and time necessary to change the yarn feed of the tufting machine over to tuft articles of another pattern or design. Also, by cutting selected yarns 31 and exchanging the yarn ends with new yarn ends drawn from a different yarn supply, and then tying the yarn ends together, different colored yarns can be fed to needles 16.

The second embodiment of the improved pattern yarn feed device of this invention operates in fashion similar to that of the first embodiment, except that an elongate pinch roller 115 is used rather than a spaced series of control rods 80, 80*a*, and 80*b*, respectively, for each yarn feed roll. Accordingly, and as illustrated generally in FIGS. 10 and 11, yarn 111 is passed through the respective spaced yarn guides 113 extending downwardly and inwardly along the length of support bracket 108, so that yarn 111 is passed toward the puller rollers (not illustrated) formed as a part of tufting machine 110, which in turn pulls the yarn toward a spaced series of needles (not illustrated) for being used in creating the patterned tufted article. When it is desired to select certain ones of the yarns from the yarn blanket (FIGS. 2, 9), the selected one of the pinch rollers 115 is released from its pair of spaced indexing plates 117, and in particular from the stub shaft mounts 124 provided as a part thereof, by pressing spring loaded stub shaft 137*a* (FIGS. 15A, 15B) inwardly of the end of the pinch roller, and then lifting the pinch roller out from between the indexing plates such that the second stub shaft 137*b* is then withdrawn from the other one of the stub shaft mounts 124 provided, as illustrated in FIG. 12.

The pinch roller is threaded through the yarn blanket so that selected ones of the yarns may be applied about the periphery of the yarn feed roll, and so that other ones of the yarns will be left undisturbed. Once this is accomplished, the pinch roller is replaced in its position on indexing plates 117 by being received within stub shaft mounts 124 in reverse of the procedure described above. Thereafter, locking mechanism 158 (FIG. 12) is released in fashion described for locking mechanism 70 of the first embodiment of this invention, such that indexing plates 117 are then rotated together about feed roll 116 in eccentric fashion, however, as opposed to concentric fashion in the first embodiment of the invention, such that pinch roller 115 progressively moves into engagement with a portion of the periphery of yarn feed roll 116, as illustrated in FIG. 11.

Figure 14:
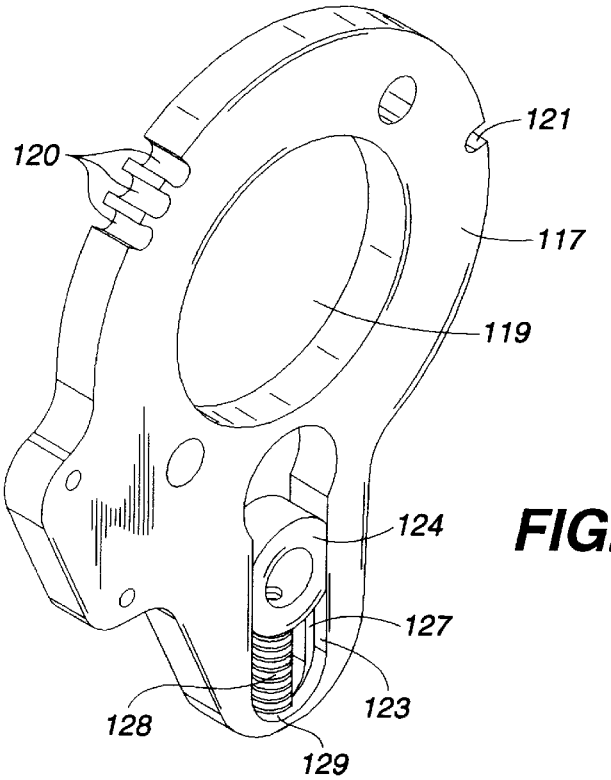
FIG. 14 is a perspective view of an indexing plate of the yarn feed roll assembly of the yarn feed device of FIGS. 10 through 13.

As illustrated in FIGS. 13 and 14, in the yarn applying position locking mechanism 158 may be received in any one of the three recesses 120 defined in the periphery of indexing plate 117 such that the amount of spring compression exerted by compression springs 143 on stub shaft mounts 124, and in turn on pinch roller 115, may be varied. This will typically occur when, for example, yarns of different diameters or weights are being used so that positive control of the yarns can be maintained with the same feed roll assemblies without the need to change out and replace either the pinch roller 115 or yarn feed roll 116.

Yarn idler rod 114 is removed from its base sections 147*a*, 147*b* on both of opposed support brackets 108 in fashion identical to the removal and replacement of control rods 80, 80*a*, and 80*b*, respectively, from the sockets (not illustrated) formed as a part of the yarn feed roll assemblies of the first embodiment of the invention, such that once pinch roller 115 has been passed between selected ones of yarns 111 for being wrapped about a portion of the periphery of yarn feed roll 116, yarn idler rod 114 is removed from its respective base portions whereupon the pinch roller is orbited about yarn feed roll 116 into the desired position, at which time yarn idler rod 114 is passed under the selected yarns and used to lift them upwardly and away from the periphery of yarn feed roll 116. Yarn idler rod 114 is then replaced on its base portions 147*a*, 147*b*, respectively, for holding the selected yarns 111 away from the yarn feed roll, so that they are not otherwise engaged with the periphery of the yarn feed roll prior to being placed there by the pinch roller.

When, and if, it is desired to vary the compression of the pinch roller against the surface of the feed roll, locking mechanism 158 is released so that the plunger (not illustrated) provided as a part thereof may be moved to any one of the respective recesses 120 defined in the periphery of indexing plate 117. When it is desired to remove the selected yarns engaged on the periphery of yarn feed roll 116, yarn idler rod 114 is removed from its base portions, the locking mechanism 158 is released, alignment bar 131 is grasped and used to rotate indexing plates 117 about eccentric cam 156 so that pinch roller 115 is progressively moved away from the periphery of the yarn feed roll, as illustrated generally in FIG. 11, whereupon pinch roller 115 is removed from stub shaft mounts 124 in the fashion described above, and the yarns are allowed to fall back into the yarn blanket, whereupon the pinch roller is placed back into the stub shaft mounts until the next selected series of yarns is chosen.

The operation of the third embodiment of yarn feed roll assembly 205 is illustrated in FIGS. 16A–16H. Referring first to FIG. 16A, therefore, yarn feed roll assembly 205 is shown in its yarn receiving position, denoted by the reference character "R" in which the spring-loaded plunger 224 of locking mechanism 221 is received in recess 217 defined in the circumference and/or exterior periphery of indexing disc 211. Yarn 213 is extended through yarn guides 214 and 215, and moves in the direction of the arrow shown, along the yarn path from the yarn supply, a creel, toward the tufting needles 15, 16 (FIG. 1) of the tufting machine. Pinch roller 231 may be received within the annular openings 252 defined in the distal ends of each carrier arm 245, or may be taken out of the carrier arms at this point, as it is not being used. Moreover, spring-loaded cam mechanism 244 is positioned such that actuating cam 253 bears against camming surface 257, and urges carrier arm 245 against the bias of spring 251 such that the cam mechanism is "spring-loaded", such that upon the release of lever arm 256, as shown in FIG. 16H, the compressive force of spring 251 will move the respective carrier arms 245 toward the yarn feed roll, and will move the pinch roller 231 into engagement with the yarn driving periphery 208' of yarn feed roll 208.

Referring now to FIG. 16B, when it is desired to begin wrapping selected ones of the yarns 213 about the yarn driving periphery 208' of the yarn feed roll 208, head 225 of locking mechanism 221 is released, and plunger 224 is drawn backward out of engagement with recess 217, whereupon alignment bar 227 is grasped and indexing discs 211 (only one of which is shown for clarity) are rotated in the direction shown. Before doing this, however, pinch roller 231 has been selectively threaded through the yarn blanket, shown generally in FIG. 9, such that the selected ones of the yarns to be wrapped about yarn feed roll 208 will be placed on the side of pinch roller 231 facing toward the yarn feed roll. This is accomplished by manually grasping pins 249 of each stub shaft, and urging the stub shafts inwardly of the pinch roll 232 for releasing the pinch roller from openings 252 defined in carrier arms 245, passing the pinch roller through the yarn blanket, urging the stub shafts inwardly of the pinch roll once again by grasping pins 249, and placing the pinch roller on its carrier arms 245. This has already been done as shown in FIG. 16B, in which the pinch roller is now being rotated in a clockwise direction to begin wrapping yarn 213 about the yarn drive periphery 208' of the yarn feed roll 208. At this point in time, spring-loaded cam mechanism 244 is still in the position that spaces pinch roller 231 from the yarn feed roll.

Thereafter, as shown in FIGS. 16C and D, the indexing discs 211 are rotated until such time as the second recess 219 is positioned in alignment with spring-loaded plunger 224, whereupon the internal bias of the compression spring (not illustrated) provided as a part of the plunger, drives the plunger into the recess, whereupon head 225 can be threaded for locking the plunger in position, or the plunger can be left unlocked such that once the alignment bar 227 is grasped once again, the plungers will be urged out of the recesses and will ride along the periphery of indexing discs 211 once again. Control rod 229 has not yet been placed within its socket 228 as the indexing disc, i.e. the yarn feed roll assembly, has not been rotated enough such that the yarn passed about pinch roller 231 will not engage the yarn driving periphery of the yarn feed roll as the yarn passes toward, about, and away from the pinch roller and about the yarn driving periphery of the yarn feed roll.

However, if a further degree of wrap is required, the plunger 224 is then urged inwardly once again and out of recess 219, alignment bar 227 is grasped for rotating the indexing discs 211, the indexing discs are rotated, and control rod 229 will thus engage yarn 213 and will hold it away from the yarn driving periphery of the yarn feed roll, as shown in FIGS. 16F, G, and H. Although only one control rod 229 is shown in FIGS. 16E–H, if a still greater degree of yarn wrap is desired, then it would be anticipated that a second radially spaced control rod would be situated within additional sockets (not illustrated) defined within the respective indexing discs, and would continue to hold the yarn away from the yarn driving periphery of the yarn feed roll as is shown generally in FIGS. 7 and 8 of the first embodiment of the invention. As shown in FIGS. 16E–G, the spring-loaded cam mechanism is still positioned such that the pinch roller is spaced from the yarn driving periphery of the yarn feed roll, and acts as a control rod itself, and not as a pinch roller to compress the selected ones of the yarns against the yarn feed roll.

Referring now to FIG. 16G, plunger has been urged into recess 220 by the force of its compression spring, and is locked in position by head 225, as no further rotation of the indexing discs is anticipated, although, and as described above, a spaced series of recesses could be provided in lieu of recess 220, for "fine tuning" the yarn wrap about the yarn feed roll, as is shown generally in FIGS. 11–14. In FIG. 16G, however, pinch roller 231 is still spaced from the periphery of the yarn feed roll, as lever arm 256 of the spring-loaded cam mechanism 244 has not yet been moved to move actuating cam 253 against camming surface 257 of the respective carrier arms. However, as shown in FIG. 16H, lever arm 256 has been moved in the direction shown by arrow 256' such that the pinch roller moves in the direction shown by arrow 231' for yieldably engaging the pinch roller against the yarn driving periphery 208' of yarn feed roll 208.

Yarn 213 passes through first yarn guide 215, passes partially about control rod 229, passes partially about pinch roller 231, is then passed about a portion of the yarn driving periphery 208' of yarn feed roll 208, and then is passed through the second yarn guide 216 and extends downwardly toward the needles of the tufting machine. Thus, as shown in FIGS. 16A–16H, the amount of yarn wrap about yarn feed roll 208 can be varied, as desired, and as necessary in light of the amount of control desired over the yarns.

Therefore, in contrast to the embodiment of the pattern yarn feed device illustrated in FIGS. 10–15C, the rotation of indexing discs 211 about yarn feed roll 208 will not result in pinch roller 231 being engaged on the periphery of the yarn feed roll, until, and unless spring-loaded cam mechanism 244 is actuated for selectively moving the pinch roller into engagement with the yarn driving periphery of the yarn feed roll. If it is not desired, or needed, it is anticipated that the pinch roller will not be moved into engagement with the yarn feed roll, and will merely act as a first or second control rod for applying selected portions of the selected ones of the yarns to the yarn driving periphery of the yarn feed roll. As with the pinch roller 135 of FIGS. 10–15C, it is anticipated that the pinch roll 232 of FIGS. 17A, 17B will be a hollow elongate polished steel tube, although the pinch roll may have a resilient rubber or foam rubber coating, or may be provided with a sandpapered surface for imparting the required degree of control to the feed of yarn 213 toward the needles of the tufting machine.

Thus, with each of the embodiments of the invention disclosed hereinabove, selected ones of the yarns may be wrapped about selected portions of the periphery of respective yarn feed rolls, the feed rolls being provided in spaced series in alignment as shown in FIG. 10, or in an arcuate array as shown in FIG. 1, without the need to otherwise cut the yarns, or otherwise re-thread the needles 15, 16 of needle bars 14*a*, 14*b*, respectively.

While preferred embodiments of the invention have been disclosed in the foregoing specification, it is understood by those skilled in the art that variations and modifications thereof can be made without departing from the spirit and scope of the invention as set forth in the following claims. In addition, the corresponding structures, materials, acts, and equivalents of all means or step plus function elements in the claims below are intended to include any structure, material, or acts for performing the functions in combination with other claimed elements as specifically claimed herein.

We claim:

1. A pattern yarn feed device for use with a tufting machine in the manufacture of tufted articles, the tufting machine having a frame, a supply of tufting yarn, at least one needle bar supported on the frame for reciprocating motion toward and away from a tufting zone defined beneath the needle bar and through which a backing material is transversely passed, the needle bar having a plurality of tufting needles thereon, and a yarn feed path along which yarns extend from the yarn supply to the respective needles of the tufting machine, said pattern yarn feed device comprising:

a yarn feed roll assembly positioned on the frame of the tufting machine adjacent the yarn feed path, said yarn feed roll assembly having:

an elongate rotatable yarn feed roll, said yarn feed roll extending along a longitudinal axis and having an exterior yarn driving periphery for engaging yarns thereon;

means for rotating said yarn feed roll about said axis; and at least one yarn applying member, said at least one yarn applying member extending parallel to said yarn feed roll, being movable about the yarn feed roll in an orbital path, and being selectively movable from a yarn receiving position spaced from said yarn feed roll for receiving an intermediate portion of selected ones of the yarns thereon into a yarn applying position engaged with at least a portion of the yarn driving periphery of the yarn feed roll for applying the selected ones of the yarns thereto;

whereby the rotation of the yarn feed roll drives the selected ones of the yarns toward the needles of the tufting machine.

2. The yarn feed device of claim 1, wherein said at least one yarn applying member is constructed and arranged to compress the selected ones of the yarns between the yarn feed roll and said at least one yarn applying member on the at least a portion of the yarn driving periphery of the yarn feed roll in said yarn applying position.

3. The yarn feed device of claim 1, wherein said at least one orbital yarn applying member comprises an elongate pinch roller extending parallel to said yarn feed roll and supported on said yarn feed roll assembly, said yarn feed roll assembly being constructed and arranged to concentrically orbit said pinch roller about the yarn feed roll in a prescribed orbital path, wherein said pinch roller compresses the selected ones of the yarns against the at least a portion of the yarn driving periphery of the yarn feed roll in said yarn applying position.

4. The yarn feed device of claim 3, wherein said pinch roller is constructed and arranged to be yieldably engaged with the at least a portion of the yarn driving periphery of the yarn feed roll in said yarn applying position.

5. The yarn feed device of claim 3, wherein said yarn feed roll assembly comprises:

a pair of spaced carrier arms positioned at the ends of said pinch roller, said carrier arms being pivotally supported on said yarn feed roll assembly for permitting said pinch roller to move from said yarn receiving position to said yarn applying position and back, said pinch roller being rotatably journaled at its ends on said carrier arms;

said carrier arms being constructed and arranged to normally resiliently urge said pinch roller into said yarn applying position; and a lever for each said carrier arm, said levers being operably engaged with a respective one of said carrier arms and being constructed and engaged to selectively move said pinch roller out of said yarn applying position into said yarn receiving position.

6. The yarn feed device of claim 5, said pinch roller including a stub shaft at each of its ends for rotatably journaling the pinch roller on said carrier arms, and wherein at least one of said stub shafts is spring loaded and is normally resiliently urged into engagement with one of said carrier arms.

7. The yarn feed device of claim 5, said pinch roller including a stub shaft at each of its ends for rotatably journaling the pinch roller on said carrier arms, and wherein said stub shafts are each spring loaded and normally resiliently urged into engagement with one of said carrier arms.

8. The yarn feed device of claim 7, wherein said spring loaded stub shafts are constructed and arranged to center said pinch roller between said carrier arms.

9. The yarn feed device of claim 3, said at least one yarn applying member further comprising at least one elongate yarn control rod supported on said yarn feed roll assembly in a position spaced from and parallel to said yarn feed roll, said yarn control rod being circumferentially spaced about the yarn feed roll from said pinch roller, and being selectively positionable about the yarn feed roll for holding the selected ones of the yarns away from the yarn feed periphery of the yarn feed roll.

10. The yarn feed device of claim 9, wherein said yarn feed roll assembly is constructed and arranged to move said pinch roller and said at least one control rod together about said yarn feed roll in said orbital path.

11. The yarn feed mechanism of claim 1, comprising a series of said yarn feed roll assemblies spaced from one another and positioned adjacent the yarn feed path, the yarn feed roll of each said yarn feed roll assembly being constructed and arranged for rotation about its longitudinal axis independently of the rotation of the other ones of said yarn feed rolls.

12. A pattern yarn feed device for use with a tufting machine in the manufacture of tufted articles, the tufting machine having a framework, a supply of tufting yarn, at least one needle bar supported on the framework for reciprocating motion toward and away from a tufting zone defined beneath the needle bar and through which a backing material is transversely passed, the needle bar having a plurality of tufting needles thereon, and a yarn feed path along which yarns extend from the yarn supply to the respective needles of the tufting machine, said pattern yarn feed device comprising:

a series of yarn feed roll assemblies supported on the framework of the tufting machine, said yarn feed roll assemblies being spaced from one another and lying adjacent the yarn feed path;

each said yarn feed roll assembly having:

an elongate rotatable yarn feed roll extending along a longitudinal axis and having an exterior yarn driving periphery for engaging yarns thereon; and at least one yarn applying member, said at least one yarn applying member being spaced from and extending parallel to said yarn feed roll, being movable about the yarn feed roll in an orbital path, and being selectively movable from a yarn receiving position spaced from the yarn feed roll for receiving an intermediate portion of selected ones of the yarns thereon into a yarn applying position for applying the selected ones of the yarns to at least a portion of the yarn driving periphery of said yarn feed roll;

wherein said yarn feed roll assemblies are disposed in series along a line extending upwardly and outwardly away from the frame of the tufting machine.

13. The yarn feed device of claim 12, wherein said at least one yarn applying member is constructed and arranged to engage at least a portion of the yarn driving periphery of the yarn feed roll in said yarn applying position.

14. The yarn feed device of claim 12, said yarn feed roll assemblies being disposed in series along a vertical line extending upwardly away from the frame of the tufting machine.

15. The yarn feed device of claim 12, said yarn feed roll assemblies being disposed in series along a horizontal line extending away from the frame of the tufting machine.

16. The yarn feed device of claim 12, said yarn feed roll assemblies being disposed in series along an arcuate line extending upwardly and outwardly away from the frame of the tufting machine.

17. A pattern yarn feed device for use with a tufting machine in the manufacture of tufted articles, the tufting machine having a framework, a supply of tufting yarn, at least one needle bar, the needle bar having a plurality of tufting needles thereon, and a yarn feed path along which yarns extend from the yarn supply to the respective needles of the tufting machine, said pattern yarn feed device comprising:

at least one yarn feed roll assembly supported on the framework of the tufting machine adjacent the yarn feed path;

said at least one yarn feed roll assembly having:

an elongate rotatable yarn feed roll extending along a longitudinal axis and having an exterior yarn driving periphery for engaging yarns thereon; and an elongate pinch roller extending parallel to said yarn feed roll, said pinch roller being spaced from said yarn feed roll in a yarn receiving position for receiving an intermediate portion of selected ones of the yarns thereon and movable concentrically about the yarn feed roll in an orbital path, said pinch roller being constructed and arranged to be selectively movable from said yarn receiving position into a yarn applying position engaged with at least a portion of the yarn driving periphery of said yarn feed roll for applying the selected ones of the yarns thereto.

18. The yarn feed device of claim 17, wherein said pinch roller is constructed and arranged to compress the selected ones of the yarns against the at least a portion of the yarn driving periphery of the yarn feed roll in said yarn applying position.

19. The yarn feed device of claim 17, wherein said pinch roller is constructed and arranged to be yieldably engaged with the at least a portion of the yarn driving periphery of the yarn feed roll in said yarn applying position.

20. The yarn feed device of claim 17, wherein said yarn feed roll assembly comprises:

a pair of spaced carrier arms positioned at the ends of said pinch roller, said carrier arms being pivotally supported on said yarn feed roll assembly for permitting said pinch roller to move from said yarn receiving position to said yarn applying position and back, said pinch roller being rotatably journaled at its ends on said carrier arms;

said carrier arms being constructed and arranged to normally resiliently urge said pinch roller into said yarn applying position; and a lever for each said carrier arm, said levers being operably engaged with a respective one of said carrier arms and being constructed and engaged to selectively move said pinch roller out said yarn applying position into said yarn receiving position.

21. The yarn feed device of claim 20, wherein each said lever includes a cam engaged with a respective one of said carriers, said cam being sized and shaped to bias the pinch roller into said yarn receiving position from said yarn applying position.

22. The yarn feed device of claim 20, said pinch roller having separate stub shafts at each of its ends for rotatably journaling the pinch roller on said carrier arms, at least one of said stub shafts being spring loaded and being normally resiliently urged into engagement with one of said carrier arms.

23. The yarn feed device of claim 22, wherein each of said stub shafts is spring loaded and normally resiliently urged into engagement with one of said carrier arms.

24. The yarn feed device of claim 23, wherein said spring loaded stub shafts are constructed and arranged to center said pinch roller between said carrier arms.

25. The yarn fed device of claim 17, further comprising at least one elongate yarn control rod supported on said yarn feed roll assembly in a position spaced from and parallel to said yarn feed roll, said yarn control rod being circumferentially spaced about the yarn feed roll from said pinch roller, and being selectively positionable about the yarn feed roll for holding the selected ones of the yarns out of engagement with the yarn feed periphery of the yarn feed roll.

26. The yarn feed device of claim 25, wherein said yarn feed roll assembly is constructed and arranged to move said pinch roller and said at least one control rod together in said orbital path about said yarn feed roll.

* * * * *